US012478198B2

(12) United States Patent
Jain

(10) Patent No.: US 12,478,198 B2
(45) Date of Patent: Nov. 25, 2025

(54) STRETCHABLE BEDDING COMPONENTS

(71) Applicant: INDO COUNT INDUSTRIES LTD., Mumbai (IN)

(72) Inventor: Mohit Kumar Jain, Mumbai (IN)

(73) Assignee: Indo Count Industries Ltd., Mumbai (IN)

( * ) Notice: Subject to any disclaimer, the term of this patent is extended or adjusted under 35 U.S.C. 154(b) by 986 days.

(21) Appl. No.: 17/113,331

(22) Filed: Dec. 7, 2020

(65) Prior Publication Data

US 2021/0169246 A1 Jun. 10, 2021

Related U.S. Application Data

(60) Provisional application No. 62/964,860, filed on Jan. 23, 2020.

(30) Foreign Application Priority Data

Dec. 6, 2019 (IN) ..... 201921050486

(51) Int. Cl.
*A47G 9/02* (2006.01)

(52) U.S. Cl.
CPC ..... *A47G 9/0246* (2013.01); *A47G 2200/12* (2013.01)

(58) Field of Classification Search
CPC ..... A47G 9/0246
See application file for complete search history.

(56) References Cited

U.S. PATENT DOCUMENTS 2,942,280 A * 6/1960 May, Jr. ..... A47G 9/0246 5/497
3,114,156 A * 12/1963 Cobb ..... A47G 9/0246 5/497
3,290,702 A * 12/1966 Seltzer ..... A47G 9/0246 139/420 R
3,789,441 A 2/1974 Weiss
3,992,733 A * 11/1976 Racine ..... A47G 9/10 5/652
4,191,221 A * 3/1980 Boyer ..... D03D 15/47 139/426 R (Continued)

FOREIGN PATENT DOCUMENTS

BE 1028053 A1 * 9/2021
EP 2087815 A1 6/2012

(Continued)

*Primary Examiner* — Eric J Kurilla
(74) *Attorney, Agent, or Firm* — Perilla Knox & Hildebrandt LLP

(57) ABSTRACT

Stretchable bedding components reconfigurable between a neutral or retracted configuration and an expanded configuration. In example embodiments, fabric is cut and sewn to form one or more bedding components with at least some dimensions being about 5%-30% less than those of conventional or traditional bedding components. In example embodiments, the length and/or width of the bedding component is expandable between about 5%-30%. In example embodiments, the stretchable bedding components include a biocomponent yarn having a helical structure that imparts elasticity therein so as to permit stretching of the one or more bedding components.

22 Claims, 20 Drawing Sheets

(56) References Cited

U.S. PATENT DOCUMENTS 4,703,530 A * 11/1987 Gusman ..... A47G 9/0246 5/497
4,727,608 A * 3/1988 Joyce ..... A47G 9/0246 24/712
4,768,252 A * 9/1988 Ross ..... A47G 9/0246 5/497
5,142,718 A * 9/1992 Anderson ..... A47G 9/0246 5/500
5,603,132 A * 2/1997 Zafiroglu ..... D04B 21/18 5/497
6,306,499 B1 * 10/2001 Ochi ..... D01F 8/14 428/364
6,883,193 B2 4/2005 Brooks et al.
8,671,476 B2 * 3/2014 Stewart ..... A47G 9/0246 5/497
8,813,280 B1 * 8/2014 Arora ..... A47G 9/0246 5/482
10,137,625 B2 * 11/2018 Sakellarides ..... B32B 15/09
11,896,152 B2 * 2/2024 Pesina ..... A47G 9/0246
2004/0040090 A1 * 3/2004 Wootten ..... A47G 9/0246 5/497
2004/0172754 A1 9/2004 Brooks et al.
2007/0118988 A1 * 5/2007 Ho ..... A47G 9/02 5/497
2009/0176428 A1 * 7/2009 Tatsuno ..... A47G 9/086 442/181
2009/0182070 A1 * 7/2009 Miyazono ..... D01F 8/14 523/523
2009/0205134 A1 * 8/2009 Wootten, Jr. ..... A47C 31/11 5/488
2012/0255120 A1 * 10/2012 Poston ..... A47C 31/007 5/499
2016/0360905 A1 * 12/2016 Feldman ..... A47G 9/0246
2017/0164767 A1 * 6/2017 Serafini ..... A47G 9/02
2018/0110348 A1 4/2018 Pearce et al.
2020/0187683 A1 * 6/2020 Serafini ..... A47G 9/02
2020/0397163 A1 * 12/2020 Wootten, Jr. ..... A47G 9/0246
2021/0177167 A1 * 6/2021 Jain ..... A47G 9/04
2022/0304485 A1 * 9/2022 Goenka ..... A47G 9/0207
2023/0240455 A1 * 8/2023 Sinn ..... A47G 9/0246 5/496
2023/0278295 A1 * 9/2023 Unger ..... C08J 5/042 428/113

FOREIGN PATENT DOCUMENTS

GB 1452120 A 10/1976
GB 2551341 A * 12/2017 ..... A47G 9/0246
WO WO-2018220649 A1 * 12/2018 ..... A47C 31/105
WO WO-2021046195 A1 * 3/2021 ..... A41D 31/02
WO 2021176468 A1 9/2021

* cited by examiner

500

| FIG # | SIZE NAME | CONVENTIONAL OR REGULAR FITTED SIZES (WIDTH x LENGTH + DROP) | PRESENT INVENTION (WIDTH x LENGTH + DROP) |
|---|---|---|---|
| 9-10 | TWIN | 39" x 75" + 14" | 39" x 65" + 14" |
| 9-10 | TWIN XL | 39" x 80" + 14" | 39" x 65" + 14" |
| 7-8 | FULL | 54" x 75" + 14" | 54" x 60" + 14" |
| 5-6 | QUEEN | 60" x 80" + 16" | 60" x 64" + 16" |
| 3-4 | KING | 78" x 80" + 16" | 78" x 64" + 16" |
| 1-2 | CAL KING | 72" x 84" + 16" | 72" x 67" + 16" |

FIG. 11A

500'

| S # | SIZE NAME | CONVENTIONAL OR REGULAR SIZES (WIDTH x LENGTH + DROP) | PRESENT INVENTION (WIDTH x LENGTH + DROP) |
|---|---|---|---|
| 1 | TWIN | 39" x 75" + 14" | 32" x 75" + 14" |
| 2 | TWIN XL | 39" x 80" + 14" | 32" x 80" + 14" |
| 3 | FULL | 54" x 75" + 14" | 43" x 75" + 14" |
| 4 | QUEEN | 60" x 80" + 16" | 48" x 80" + 16" |
| 5 | KING | 78" x 80" + 16" | 63" x 80" + 16" |
| 6 | CAL KING | 72" x 84" + 16" | 58" x 84" + 16" |

FIG. 11B

STRETCHABLE BEDDING COMPONENTS

CROSS-REFERENCE TO RELATED APPLICATIONS

This application claims priority to U.S. Provisional Patent Application Ser. No. 62/964,860 filed Jan. 23, 2020 and Indian Provisional Patent Application Serial No. 201921050486 filed Dec. 6, 2019, the entireties of which are hereby incorporated by reference herein.

TECHNICAL FIELD

The present invention relates generally to the field of bedding, and more particularly to bedding components that are at least partially stretchable to be reconfigurable between a retracted configuration and an expanded configuration.

BACKGROUND

Bedding components such as fitted bed sheets, flat sheets, and pillow cases are commonly used to outfit a bed or mattress. Fitted bed sheets are commonly used for fitting around or at least partially encasing the mattress. Commonly, fitted bed sheets are sized to be substantially similar to the dimensions of the mattress that it is intended to cover. For example, the sizing/dimensions of conventional fitted sheets are about 72"×84"+16" (width×length+drop) for a California king size mattress, about 78"×80"+16" for a king size mattress, about 60"×80"+16" for a queen size mattress, about 54"×75"+14" for a full size mattress, about 39"×80"+14" for a twin XL size mattress, and about 39"×75"+14" for a twin size mattress. Continued improvements to bedding is sought. It is to the provision of stretchable bedding components meeting these and other needs that the present invention is primarily directed.

SUMMARY

In example embodiments, the present invention provides a stretchable bedding component that is reconfigurable between a retracted configuration and an expanded configuration. In example embodiments, the bedding component can be in the form of a fitted sheet, a flat sheet, one or more pillow cases, other bedding components and/or a combination thereof.

In one aspect, the present invention relates to a fitted bed sheet for at least partially encasing a mattress having a length, a width and a depth. In example embodiments, the fitted bed sheet includes a top panel, front and rear panels, and first and second side panels. The top panel includes a length and a width, wherein at least the top panel is stretchable along its length between a retracted configuration and an expanded configuration. In the retracted configuration, the length of the top panel is between about 5-30% less than the length of the mattress, for example about 12%-21% according to some example embodiments. In the expanded configuration, the length of the top panel is generally similar to the length of the mattress.

In example embodiments, in the retracted configuration the width of the top panel is generally similar to the width of the mattress and wherein in the expanded configuration the width is generally similar to the width of the mattress. In example embodiments, at least the top panel includes a stretchable fabric. In example embodiments, the stretchable fabric includes a blend of cotton and spandex. In example embodiments, the stretchable fabric includes a blend of cotton and a rubber or other stretchable material. In example embodiments, the stretchable fabric includes at least one fiber material selected from the group consisting of cotton fibers, polyester fibers, Tencel™ (e.g., cellulosic fibers), Lycra® (e.g., synthetic elastane fibers) and biocomponent fibers (or combinations thereof). In example embodiments, the material includes a special synthetic fiber, for example, polyester yarn. In example embodiments, at least one of the yarns of the fabric comprises a synthetic and stretchable or elastic biocomponent fiber comprising a first component and a second component. In example embodiments, the front and rear panels and first and second side panels include first sides connected to the top panel, ends that are connected to each other to define four stitched-together corners, and second sides defining exposed edges. In example embodiments, the exposed edges of the front and rear panels include elastic members secured to the entirety thereof.

In example embodiments, a portion of the exposed edges of the first and second side panels include elastic members secured thereto. In example embodiments, the elastic members of the first and second side panels extend a length of about 6 inches along the exposed edges from respective elastic members that are secured to the exposed edges of the front and rear panels. In example embodiments, rubber thread is provided for securing together the four stitched-together corners. In example embodiments, the rubber thread allows for snug fitting engagement regardless of the depth of the mattress.

In example embodiments, a V-stitch is provided and extends from an end of each of the four stitched-together corners and generally at about 90 degrees relative to each other. In example embodiments, the fitted bed sheet is configured to provide snug fitting engagement with at least two mattresses comprising differing lengths. In example embodiments, the at least two mattresses include a twin size mattress and a twin XL size mattress.

In another aspect, the present invention relates to a fitted bed sheet for at least partially encasing a mattress comprising a length, a width and a depth. The fitted bed sheet including a top panel, front and rear panels, and first and second side panels. The top panel including a length and a width, and at least a portion of the one or more panels including a stretchable fabric and at least a portion of the front, rear and first and second side panels comprising an elastic band secured thereto. In example embodiments, the fitted bed sheet in a relaxed state defines a first size, the first size being smaller than the mattress, and wherein an expanded state the fitted bed sheet defines a second size, the second size being large enough so as to at least partially encase the mattress.

In example embodiments, the fitted bed sheet is at least stretchable along its length between a relaxed state and an expanded state, and wherein in the relaxed state the length of the top panel is between about 12%-21% less than the length of the mattress and wherein in the expanded state the length of the top panel is generally similar to the length of the mattress.

In example embodiments, in the relaxed state the width of the top panel is generally similar to the width of the mattress and wherein in the expanded state the width is generally similar to the width of the mattress.

In example embodiments, the front and rear panels and first and second side panels include first sides connected to the top panel, ends that are connected to each other to define four stitched-together corners, and second sides defining exposed edges. The exposed edges of the front and rear panels include elastic members secured to the entirety thereof, and a portion of the exposed edges of the first and second side panels having elastic members secured thereto. In example embodiments, rubber thread is provided for securing together the four stitched-together corners, thereby allowing for snug fitting engagement of the fitted bed sheet with the mattress regardless of the depth of the mattress.

In another aspect, the present invention relates to a stretchable bedding component that is reconfigurable between a retracted state and an expanded state. In example embodiments, the bedding component is retractable and expandable so as to permit stretching of the bedding component in a first direction, a second direction that is perpendicular to the first direction, or in both the first and second directions. In example embodiments, the stretchable bedding component can be a fitted bed sheet, a flat bed sheet, a pillow case or covering, or other bedding components as desired.

In yet another aspect, the present invention relates to a stretchable bedding component elastically deformable between a retracted state and an expanded state. In example embodiments, the bedding component can be retractable and expandable so as to permit stretching of the bedding component in a first direction, a second direction that is perpendicular to the first direction, or bi-directional in both the first and second directions. In example embodiments, the retracted state of the bedding component is between 5-30% smaller than the expanded state of the bedding component.

In example embodiments, a fitted bed sheet, a flat bed sheet, and at least one pillow case are formed from a single elongate and stretchable fabric sheet, the fabric sheet comprising at least polyester and cotton yarns. In example embodiments, the polyester yarn comprises up to 37% plant-derived ingredients. In example embodiments, the polyester yarn comprises a helical structure such that the same is elastically stretchable between a natural state and an expanded state. In example embodiments, the polyester yarn comprises a biocomponent yarn.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of example embodiments are explanatory of example embodiments of the invention, and are not restrictive of the invention, as claimed.

BRIEF DESCRIPTION OF THE DRAWINGS

FIG. 11A shows a chart comparing dimensions of conventional fitted sheets with the dimensions of the fitted sheets as shown in FIGS. 1-10.

FIG. 11B shows a chart comparing dimensions of conventional fitted sheets with the dimensions of fitted sheets according to another example embodiment of the present invention.

DETAILED DESCRIPTION OF EXAMPLE EMBODIMENTS

The present invention may be understood more readily by reference to the following detailed description of example embodiments taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1:
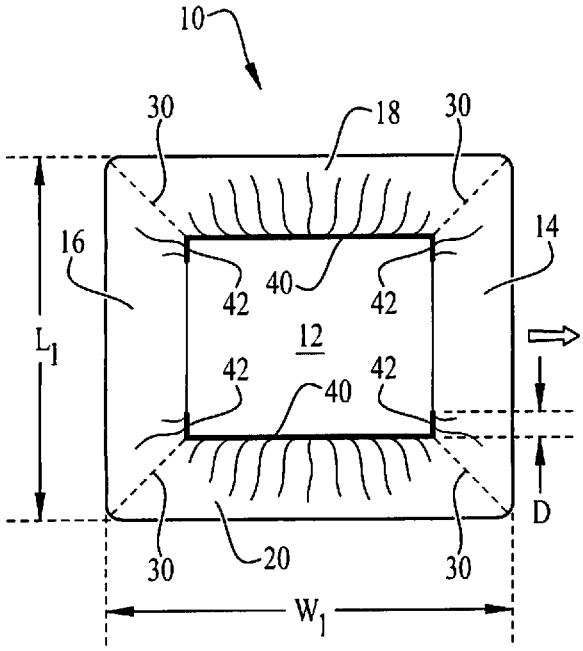
FIG. 1 is bottom plan view of a stretchable fitted sheet according to an example embodiment of the present invention, the stretchable fitted sheet being in a natural and unstretched configuration.
Figure 2:
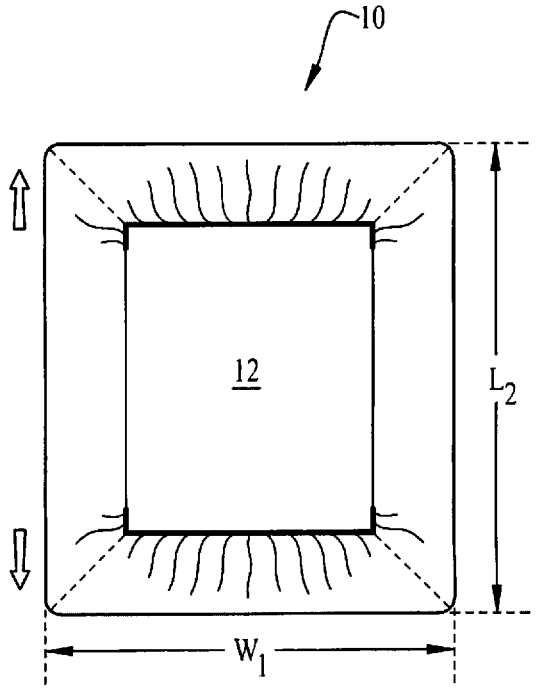
FIG. 2 is a bottom plan view of the stretchable fitted sheet of FIG. 1 in an expanded configuration.
Figure 3:
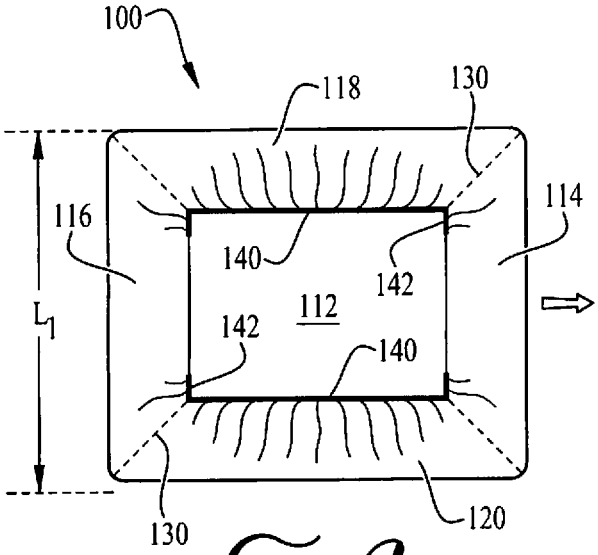
FIG. 3 is a bottom plan view of a stretchable fitted sheet according to another example embodiment of the present invention, the stretchable fitted sheet being in a natural and unstretched configuration.
Figure 4:
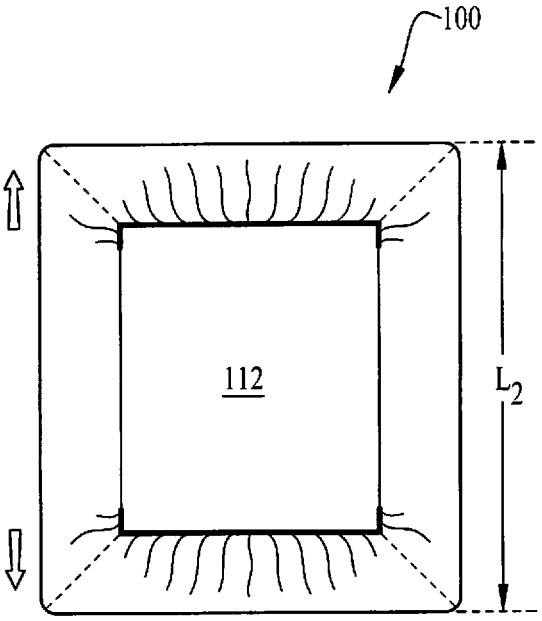
FIG. 4 is a bottom plan view of the stretchable fitted sheet of FIG. 3 in an expanded configuration.
Figure 5:
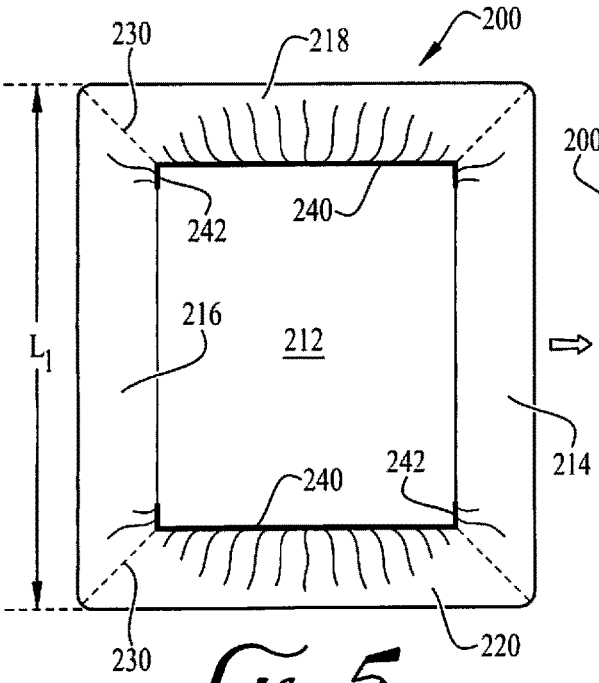
FIG. 5 is a bottom plan view of a stretchable fitted sheet according to another example embodiment of the present invention, the stretchable fitted sheet being in a natural and unstretched configuration.
Figure 6:
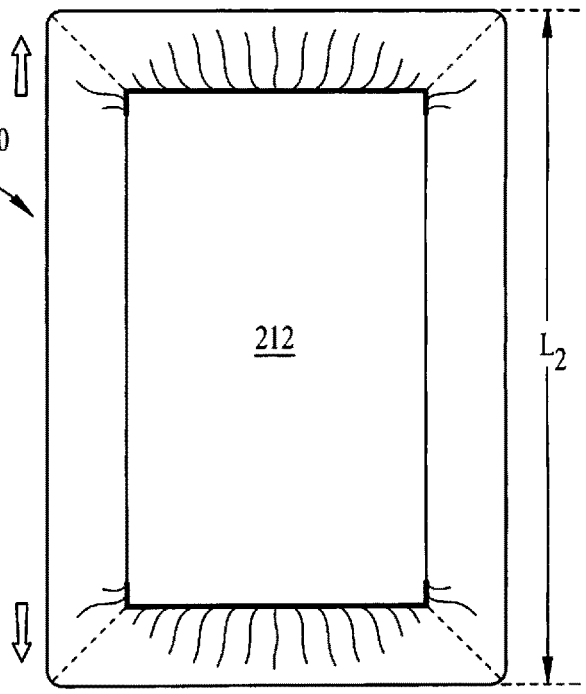
FIG. 6 is a bottom plan view of the stretchable fitted sheet of FIG. 5 in an expanded configuration.
Figure 7:
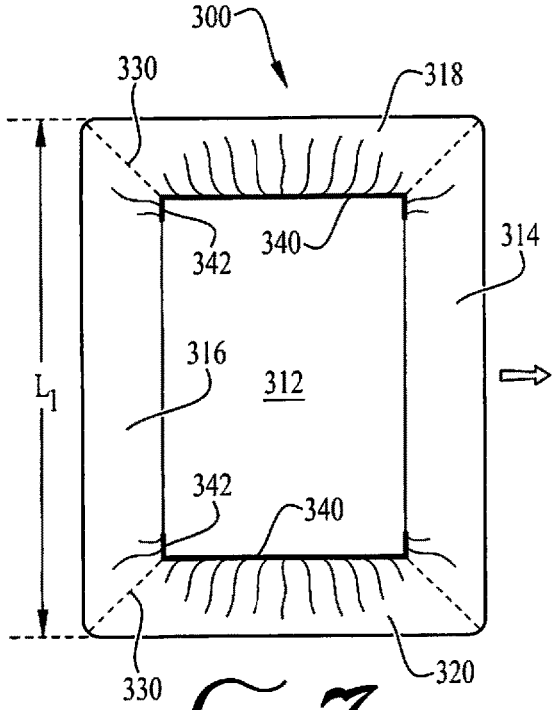
FIG. 7 is a bottom plan view of a stretchable fitted sheet according to another example embodiment of the present invention, the stretchable fitted sheet being in a natural and unstretched configuration.
Figure 8:
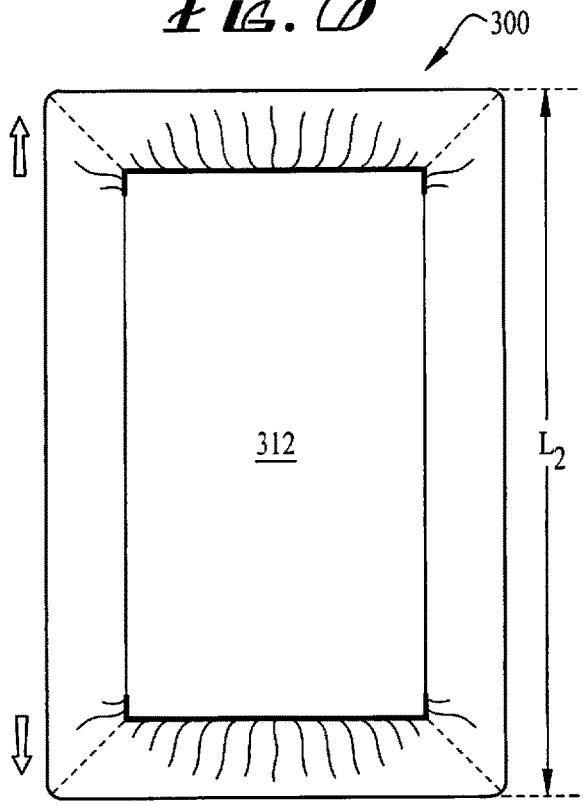
FIG. 8 is a bottom plan view of the stretchable fitted sheet of FIG. 7 in an expanded configuration.
Figure 9:
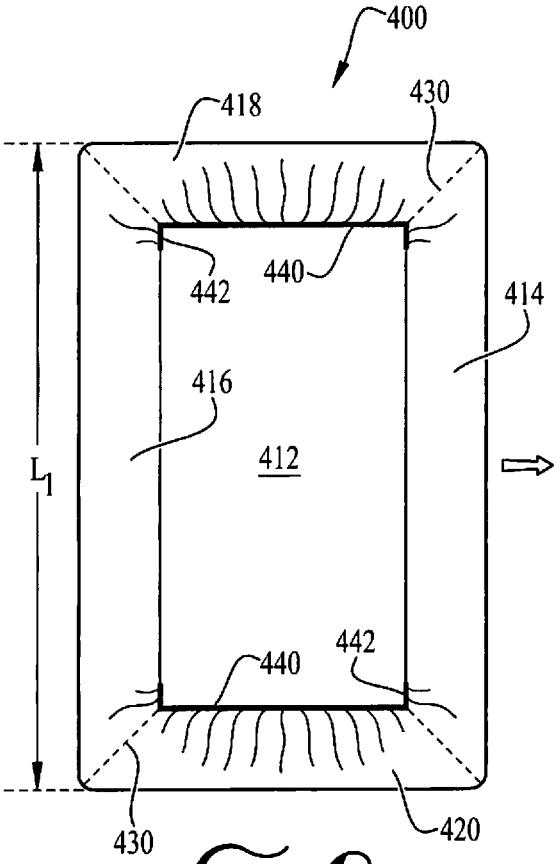
FIG. 9 is a bottom plan view of a stretchable fitted sheet according to another example embodiment of the present invention, the stretchable fitted sheet being in a natural and unstretched configuration.
Figure 10:
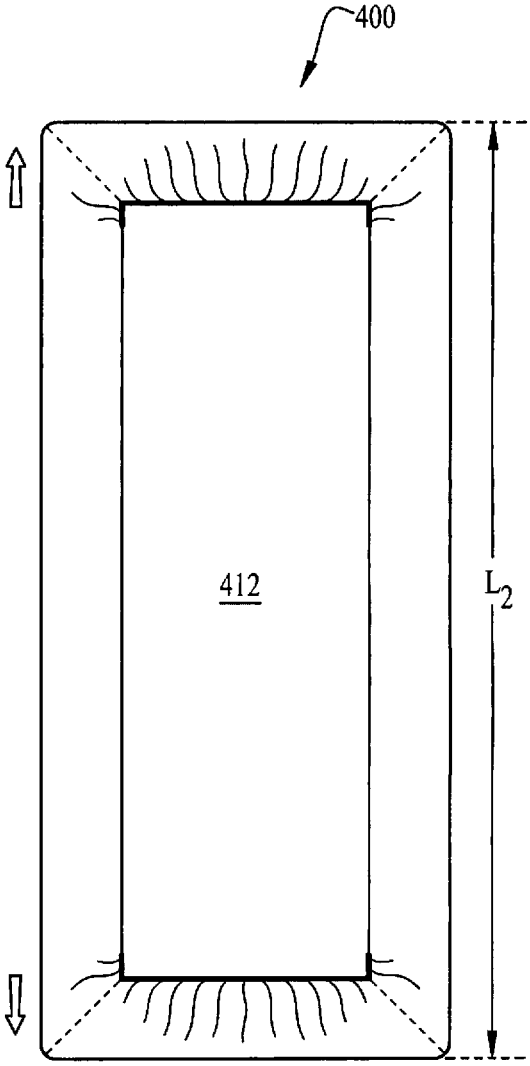
FIG. 10 is a bottom plan view of the stretchable fitted sheet of FIG. 9 in an expanded configuration.

With reference now to the drawing figures, wherein like reference numbers represent corresponding parts throughout the several views, FIGS. 1-10 show a plurality of fitted bed sheets according to example embodiments of the present invention. For example, FIGS. 1-2 show a fitted sheet 10 that is configured for attachment to a California king size mattress, FIGS. 3-4 show a fitted sheet 100 that is configured for attachment to a king size mattress, FIGS. 5-6 show a fitted sheet 200 that is configured for attachment to a queen size mattress, FIGS. 7-8 show a fitted sheet 300 that is configured for attachment to a full size mattress, FIGS. 9-10 show a fitted sheet 400 that is configured for attachment to a twin and twin XL size mattresses.

In example embodiments, the fitted sheets as described herein comprise a top panel, first and second side panels, a front panel and a rear panel. According to example embodiments of the present invention, the fabric of the top panel, first and second side panels, and front and rear panels are constructed from a stretchable fabric. For example, according to one example embodiment, the stretchable fabric comprises a blend of cotton and Spandex, or for example, a blend of natural or at least soft fibers blended with at least partially elastic fibers or other stretchable fibers or other material. According to one example embodiment, the fabric comprises a blend of cotton and Lycra. According to another example embodiment, the fabric comprises a blend of cotton and elastane. According to another example embodiment, the fabric comprises a blend of cotton and polyester. According to another example embodiment, the fabric comprises a blend of at least two of the following materials selected from cotton, Spandex, Lycra® (e.g., synthetic elastane fibers), elastane, polyester, Tencel™ (e.g., cellulosic fibers), Modal, bamboo, silk, soy, X-STATIC®, milk, viscose and/or other rubber, elastic or other stretchable materials/fibers.

According to one example embodiment, the fabric comprises multi-filament or biocomponent yarns in the weft and cotton yarns in the warp. In example embodiments, the biocomponent yarn comprises a first component and a second component. According to one example embodiment, the first component comprises polytrimethylene terephthalate (PTT) and the second component comprises polyethylene terephthalate (PET). According to example embodiments, the biocomponent yarn comprises about 37% PTT and about 63% PET, and the cotton yarn comprises 100% cotton. Optionally, according to other example embodiments, the proportions of the components can be varied as desired so as to provide a desired amount of elasticity/stretchability in the fabric. According to example embodiments, the biocomponent yarns comprise up to about 37% plant-derived ingredients, for example, which has a melting temperature of between about 220-240 degrees Celsius, for example, 230 degrees Celsius according to one example embodiment. In example embodiments, the biocomponent yarn imparts at least some stretching or elasticity, for example, whereby processing of the same causes a helical structure to form in the yarn. In example embodiments, the biocomponent yarn is elastically deformable or stretchable, for example, such that the yarn comprises a relaxed or neutral configuration, and for example, an expanded or stretched configuration that permits between about 5-30% elongation thereof. In example embodiments, the biocomponent yarn is elastic in that the biocomponent yarn will retract to is relaxed configuration and maintain a substantially similar dimension after being stretched to the expanded configuration. Accordingly, the fabric comprising the biocomponent yarn similarly elastically deforms or can stretch between the relaxed and expanded configurations. Accordingly, the biocomponent yarn and the stretchable fabric formed therefrom elasticity so as to not impart any plastic or permanent deformation. As will be described below, the stretchability of the fabric of the sheets as described herein is preferably beneficial in the reduction of material consumption while providing that at least one dimension thereof is reconfigurable between a retracted configuration (see FIGS. 1, 3, 5, 7 and 9) and an expanded configuration (see FIGS. 2, 4, 6, 8 and 10).

As depicted in FIGS. 1-2, the fitted sheet 10 comprises a top panel 12, first and second side panels 14, 16, a front panel 18 and a rear panel 20. In example embodiments, as will be described in greater detail below, the sides of the panels 14, 16, 18 and 20 are connected together to define stitched-together corners or seams 30. According to example embodiments, a rubber or elastic thread can be provided for connecting the sides of the panels 14, 16, 18 and 20, for example, so as to provide some elasticity or stretchability along the length of the seams 30.

In example embodiments, each of the panels 14, 16, 18 and 20 comprise exposed edges, for example, which can be hemmed or otherwise tailored to conceal and protect any cut edges or other fabric portions which may fray or unravel. The sizing of the panels 14, 16, 18 and 20 define the drop thereof, for example, which are generally configured for covering the vertical sides of the mattress and generally at least partially covering a lower side thereof. According to one example embodiment, the exposed edges of the front and rear panels 18, 20 comprise an elastic material or band 40, for example, which extends along the entirety thereof. According to one example embodiment, the band 40 comprises 1-inch broad boxer elastic. Furthermore, at least a portion of the exposed edges of the first and second side panels 14, 16 comprise an elastic material or band 42 connected thereto. For example, according to one example embodiment, the first and second side panels 14, 16 comprise segments of the elastic band 42 secured near the ends thereof and generally proximal the band 40 of the front and rear panels 18, 20. According to one example embodiment, the elastic band 42 extends a length D along the exposed edges of the first and second side panels 14, 16 from opposite ends thereof. According to example embodiments, the length D is generally between about 4-9 inches. According to one example embodiment, the length D is between 6-7 inches. As similarly described above, the elastic band 42 can comprise 1-inch broad boxer elastic. According to other example embodiments, the elastic band 42 comprises boxer elastic comprising a width of between about 0.5-1.5 inches. In other example embodiments, the width of the elastic band 42 can be between about 0.25-2.5 inches, any desired width.

With reference to FIG. 1, the fitted sheet 10 is in a natural or retracted configuration and defines a length L1 and a width W1. In example embodiments, the length L1 is about 67 inches and the width W1 is about 72 inches. And as depicted in FIG. 2, the fitted sheet 10 is in an expanded configuration defining a length L2 and a width W1. According to example embodiments, the length L2 is about 84 inches and the width W1 is about 72 inches (as described above). Thus, according to example embodiments, the length L2 is about 20% greater than the length L1. As such, the fitted sheet 10 of the present invention consumes less fabric along its length, for example, in comparison to a conventional fitted sheet. As described above, the fitted sheet 10 of FIGS. 1-2 are sized for fitting (e.g., at least partially enclosing/encasing) a California king size mattress. According to example embodiments of the present invention, it is the stretchability of the fabric of the fitted sheet (and the bands 40, 42 thereof) that preferably allow for expansion/contraction of the fitted sheet, and for example, provides for a snug or close-fitting engagement of the fitted sheet 10 with the mattress.

With reference to FIGS. 3-4, the fitted sheet 100 similarly comprises a top panel 112, first and second side panels 114, 116, a front panel 118 and a rear panel 120. Furthermore, the exposed edges thereof comprise elastic bands 140, 142 as similarly described above. According to example embodiments, the sheet 100 is configured for fitting a king size mattress. The sheet defines a first length L1 is its retracted configuration and a second length L2 in its expanded configuration. According to example embodiments of the present invention, the length L1 is about 64 inches and the length L2 is about 80 inches. In example embodiments, the width of the sheet is about 78 inches in either of the retracted or expanded configurations and the drop of the side panels 112, 114, 116 and 118 is generally about 16 inches.

With reference to FIGS. 5-6, the fitted sheet 200 similarly comprises a top panel 212, first and second side panels 214, 216, a front panel 218 and a rear panel 220. Furthermore, the exposed edges thereof comprise elastic bands 240, 242 as similarly described above. According to example embodiments, the sheet 200 is configured for fitting a queen size mattress. The sheet 200 defines a first length L1 in its retracted configuration and a second length L2 in its expanded configuration. According to example embodiments of the present invention, the length L1 is about 64 inches and the length L2 is about 80 inches. In example embodiments, the width of the sheet is about 60 inches in either of the retracted or expanded configurations and the drop of the side panels 212, 214, 216 and 218 is generally about 16 inches.

With reference to FIG. 7-8, the fitted sheet 300 similarly comprises a top panel 312, first and second side panels 314, 316, a front panel 318 and a rear panel 320. Furthermore, the exposed edges thereof comprise elastic bands 340, 342 as similarly described above. According to example embodiments, the sheet 300 is configured for fitting a full-size mattress. The sheet 300 defines a first length L1 in its retracted configuration and a second length L2 in its expanded configuration. According to example embodiments of the present invention, the length L1 is about 60 inches and the length L2 is about 75 inches. In example embodiments, the width of the sheet is about 54 inches in either of the retracted or expanded configurations and the drop of the side panels 312, 314, 316 and 318 is generally about 14 inches.

With reference to FIGS. 9-10, the fitted sheet 400 similarly comprises a top panel 412, first and second side panels 414, 416, a front panel 418 and a rear panel 420. Furthermore, the exposed edges thereof comprise elastic bands 440, 442 as similarly described above. According to example embodiments, the sheet 400 is configured for fitting either of a twin or twin XL size mattresses (e.g., 39"×75"+14" for a twin size mattress, 39"×80"+14" for a twin XL size mattress).

The sheet 400 defines a first length L1 in its retracted configuration and a second length L2 in its expanded configuration. According to example embodiments of the present invention, the length L1 is about 65 inches and the length L2 is between about 75-80 inches. In example embodiments, the width of the sheet is about 39 inches in either of the retracted or expanded configurations and the drop of the side panels 412, 414, 416 and 418 is generally about 14 inches. According to example embodiments, the sheet 400 is preferably configured such that the length L2 in the expanded configuration can accommodate fitting both a twin size mattress and a twin XL size mattress.

As depicted in FIG. 11A, a chart 500 depicts dimensions of conventional or traditional fitted sheets along with dimensions of the fitted sheets of the present invention. For example, for a California king size mattress, a conventional fitted sheet is 72"×84"+16" compared to the fitted sheet of the present invention being 72"×67"+16". For a king size mattress, a convention fitted sheet is 78"×80"+16" compared to the fitted sheet of the present invention being 78"×64"+16". For a queen size mattress, a conventional fitted sheet is 60"×80"+16" compared to the fitted sheet of the present invention being 60"×64"+16". For a full size mattress, a conventional fitted sheet is 54"×75"+14" compared to the fitted sheet of the present invention being 54"×60"+14". For a twin XL size mattress, a conventional fitted sheet is 39"×80"+14" compared to the fitted sheet of the present invention being 39"×65"+14". For a twin size mattress, a convention fitted sheet is 39"×75"+14" compared to the fitted sheet of the present invention being 39"×65"+14".

Figure 18:
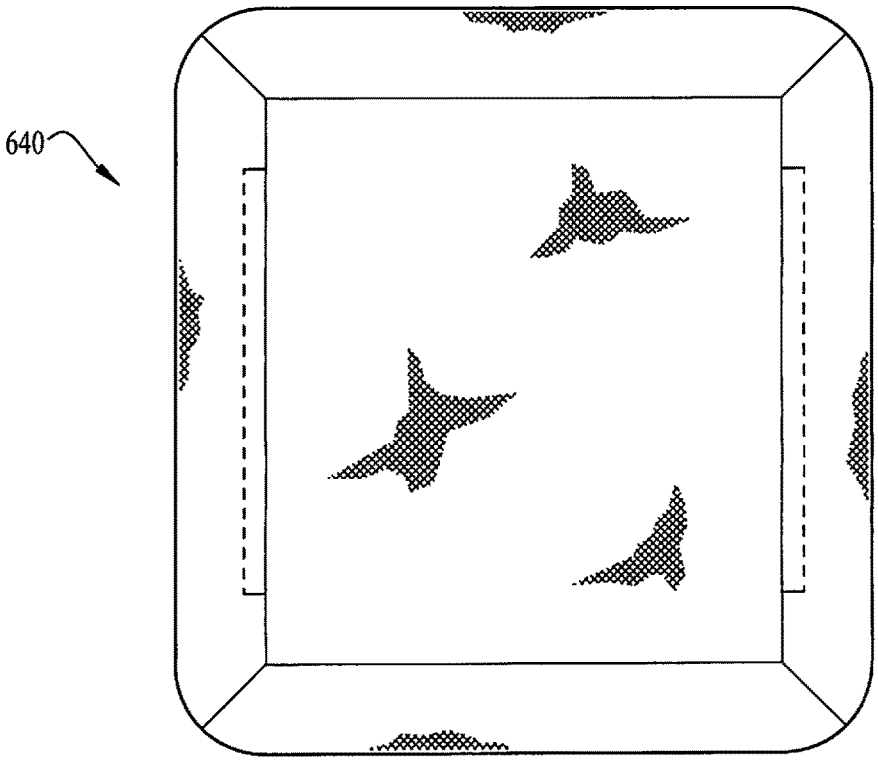
Figure 19:
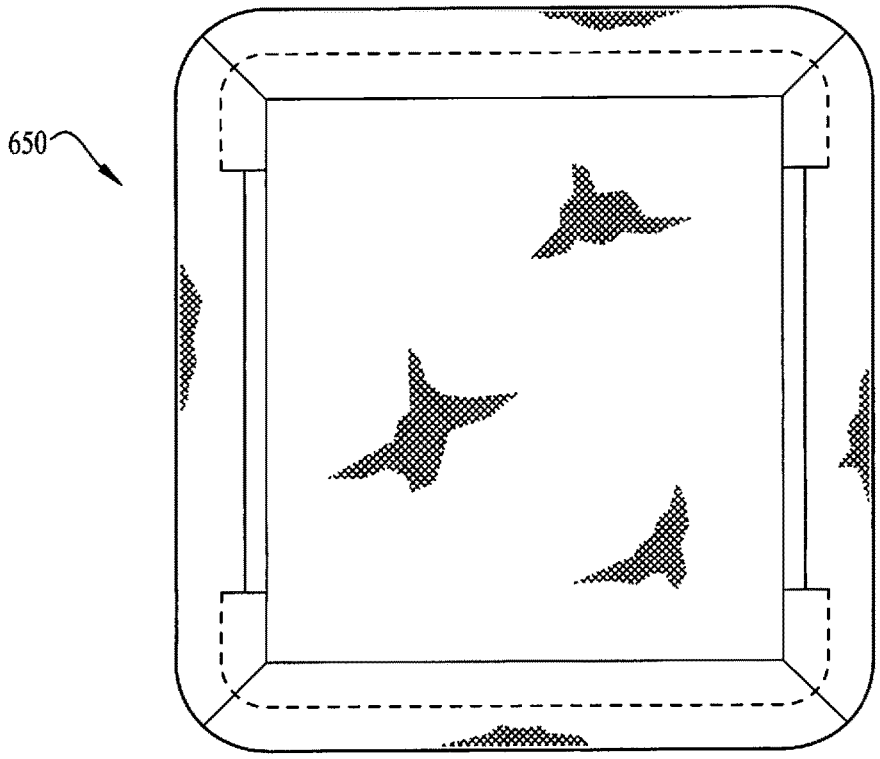
Figure 20:
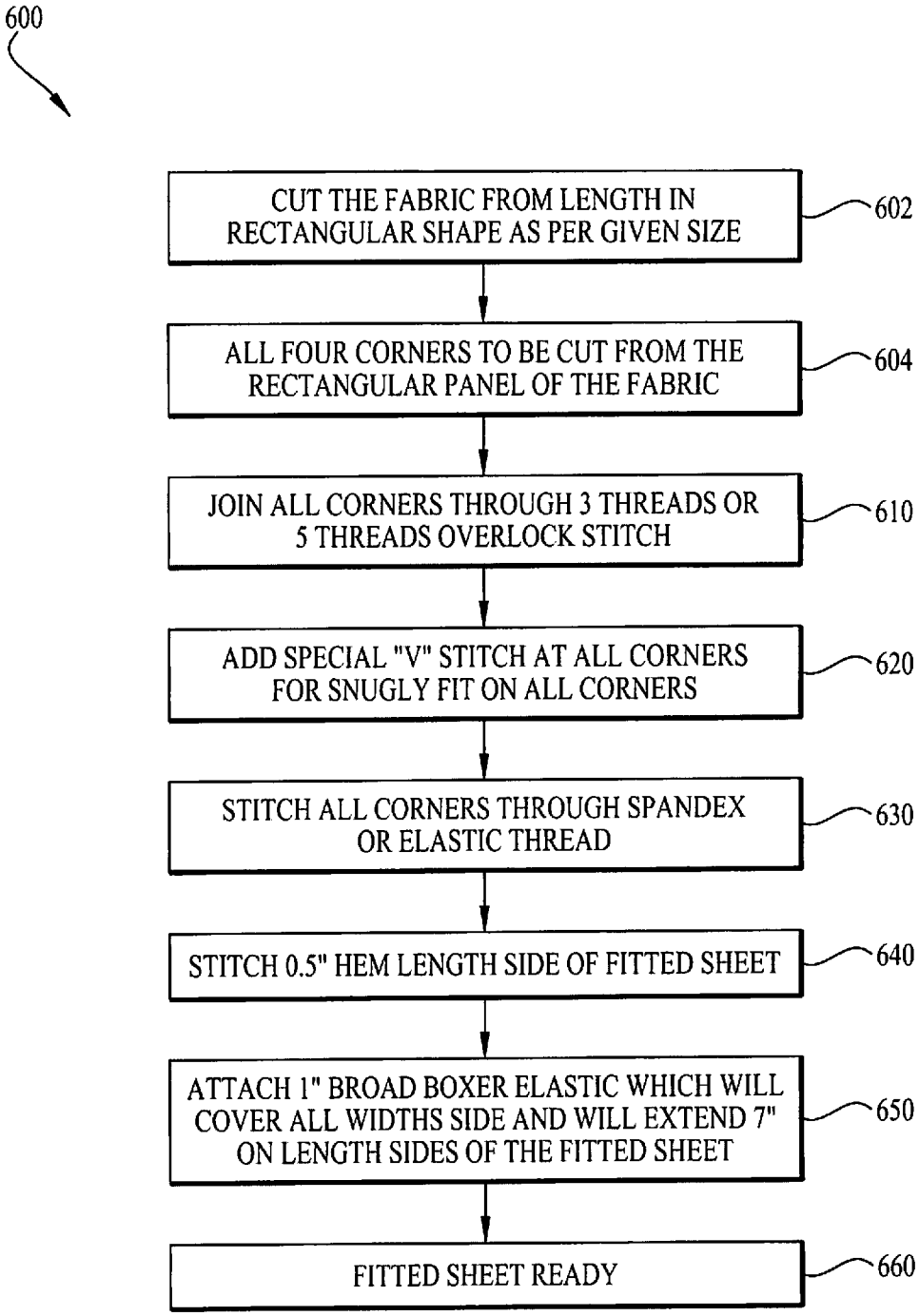
FIG. 20 shows a flow chart of the sequence of operation of the stitching process of FIGS. 12-19.

FIGS. 12-19 show a step-by-step process of manufacturing the fitted sheets of the present invention and FIG. 20 shows a flow chart of the manufacturing process 600 thereof.

Figure 12:
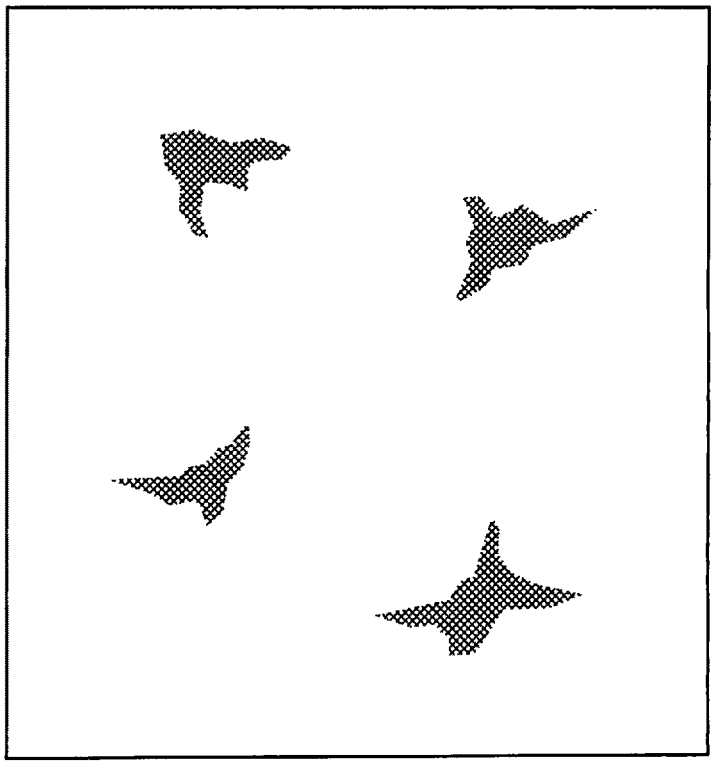
FIGS. 12-19 show top plan views of a sequence of operation of a stitching process to form the stretchable fitted sheet of FIGS. 1-10 according to an example embodiment of the present invention.
Figure 13:
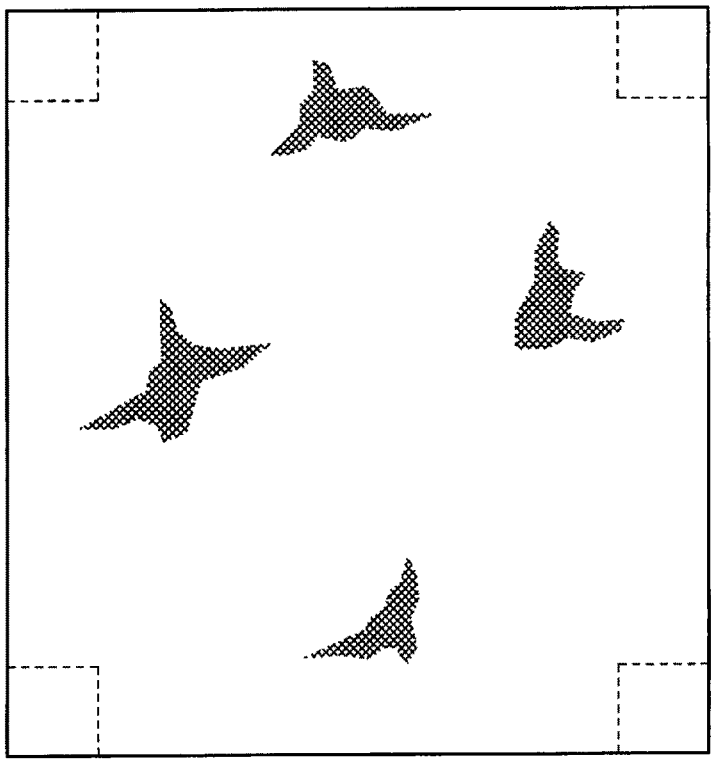
Figure 14:
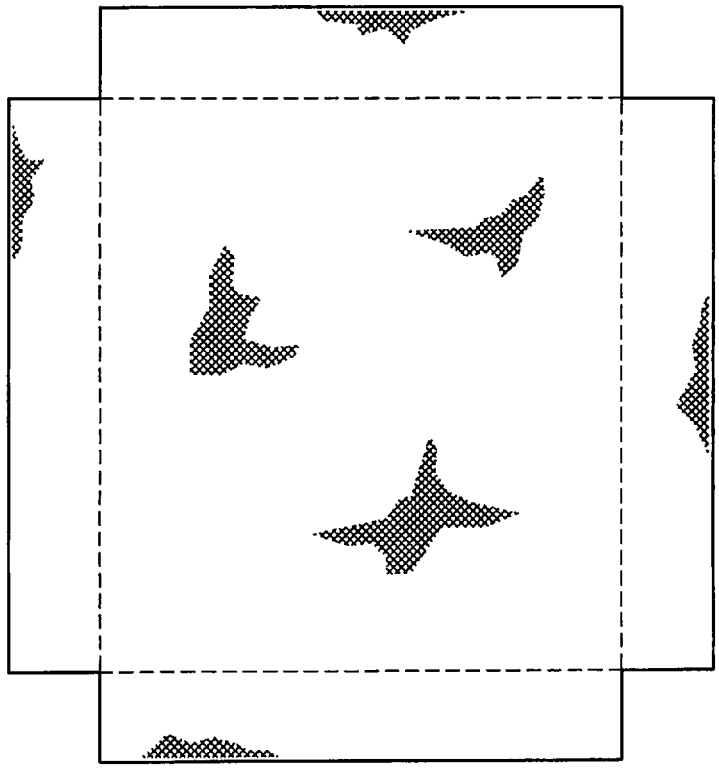
Figure 15:
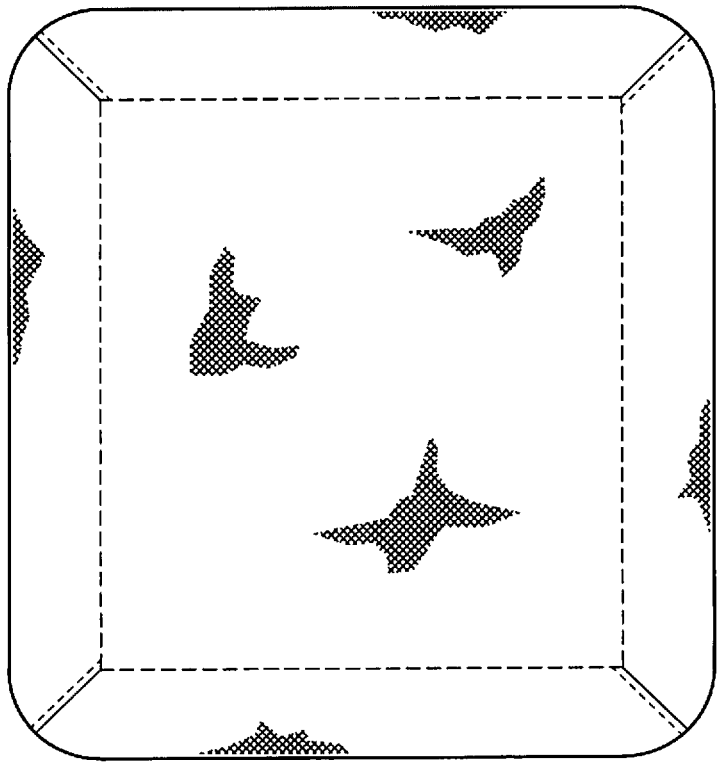
Figure 16:
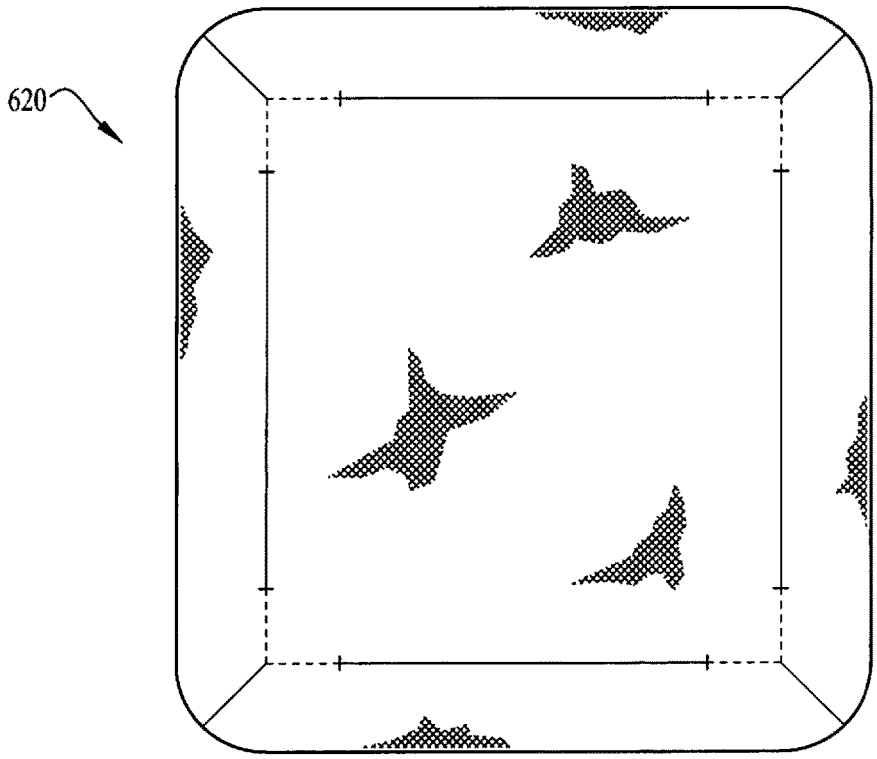
Figure 17:
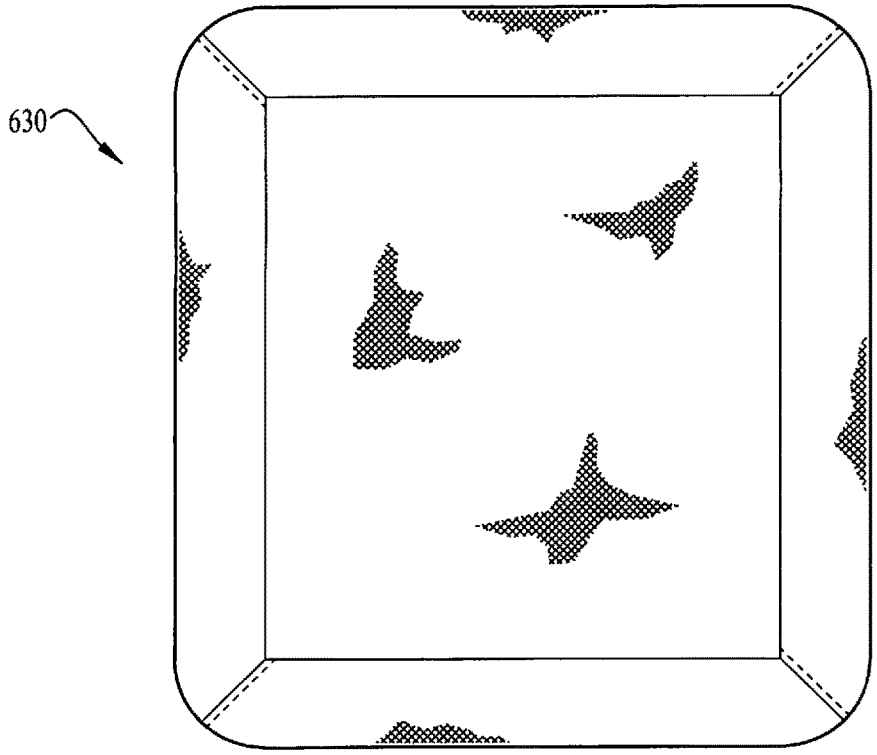

As depicted in FIG. 12, the fabric is cut to form a rectangular shape, for example, which is sized according to the particular mattress size it is intended to cover (see step 602). As depicted in FIG. 13, all four corners are cut and removed from the rectangular fabric (see step 604). As depicted in FIGS. 14-15, the ends of each side and end panel are joined together through a 5-thread or 3-thread overlock stitch (see step 610). As depicted in FIG. 16, a "V" stitch is provided at least at one end of the 5-thread or 3-thread overlock stitch (see step 620). As depicted in FIG. 17, a spandex or otherwise elastic thread is stitched along the 5-thread or 3-thread overlock stitch (see step 630). As depicted in FIG. 18, portions of the first and second side panels are provided with a 0.5 inch hem (see step 640). And as depicted in FIG. 19, an elastic band or 1-inch broad boxer elastic (optionally between 0.5-1.5 inch width band) is attached to the entirety of the exposed edges of the front and rear panels and to portions of the first and second side panels (see step 650). According to example embodiments and as described above, the elastic band or boxer elastic extends between about 6-7 inches along the first and second side panels from the ends thereof. Optionally, the hem size of step 640 can be chosen as desired, for example, between about 0.5-1.5 inches according to some example embodiments. In yet another example embodiment, the hem provided in step 640 can be sized as desired, for example, between about 0.25-2.5 inches, or for example, any desired size.

Figure 21:
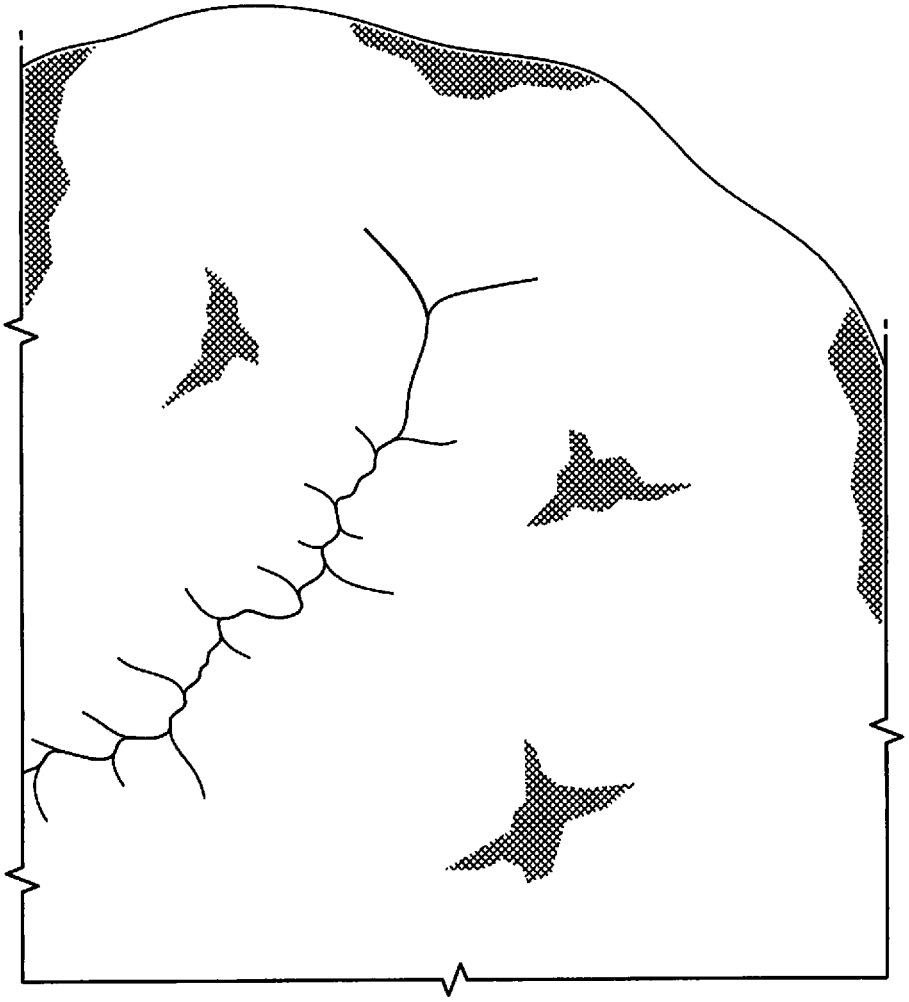
FIG. 21 shows a perspective view of a portion of a stretchable fitted bed sheet according to an example embodiment of the present invention, and showing a V-stitch and elastic stitching provided in the corner thereof.

FIG. 21 shows side panels stitched together with the 5-thread or 3-thread overlock stitch, the elastic stitching, and the "V" stitch extending from the overlock stitch. Thus according to example embodiments of the present invention, at least one dimension of the fitted sheet can be reduced compared to conventional or traditional fitted sheets. According to example embodiments, the length of the fitted sheet is reduced between about 15%-20% compared to traditional or conventional fitted sheets. And due to the fabric of the fitted sheet being stretchable, the length thereof can be expanded by 15%-20% such that the fitted sheet fittingly engages the mattress, and for example, provides for snug fitting engagement therewith. As such, the present invention allows for a reduction in the consumption of fabric, for example, such that less fabric is required to construct a fitted sheet according to the present invention in comparison to conventional or traditional fitted sheets. According to example embodiments, the "V" stitch prevents the respective corner thereof from "popping up", "slipping", or gradually coming off during use. In example embodiments, rubber thread has been stitched on the all four corners of this fitted sheet for flexible fitting on the desired mattress without compromising the look of the corners. Preferably, the elastic stitching permits fitting on multiple depths (drops) of the fitted sheet (e.g., 10-22 inches). And in comparison to conventional or traditional fitted sheets, the fitted sheet of the present invention allows for a reduction in the consumption of boxer elastic, for example, between about a 40%-60% reduction in boxer elastic compared to conventional or traditional fitted sheets.

According to one optional example embodiment, the width of the fitted sheet can similarly be reduced when compared to a similar-sized traditional or conventional fitted sheet. Thus, in a similar manner, due to the fabric of the fitted sheet being stretchable, the width thereof can be expanded such that the fitted sheet fittingly engages the mattress, and for example, provides for snug fitting engagement therewith. Thus, according to some example embodiments, either the length or the width of the fitted sheet of the present invention is sized to be at least partially less than a similar-sized conventional or traditional fitted sheet. According to example embodiments, the stretchable material is stretchable in one dimension, for example, such that depending on the orientation and construction of the fabric the fitted sheet is stretchable in either the length or width. For example, FIG. 11B shows a chart 500' depicting dimensions of conventional or traditional fitted sheets along with dimensions of the fitted sheets having a reduced width. Thus, according to example embodiments, the fitted sheet of the present invention can be configured so as to provide expansion/contraction of the width of the fitted sheet rather than the length of the fitted sheet. According to yet another example, the fitted sheet is configured so as to provide stretchability in both the length and width, for example, such that the fitted sheet can stretch or expand between about 5-30% in either (or both) the length or width. Thus, according to some example embodiments, the fitted sheet in a relaxed state or configuration is between about 5-30% smaller than the mattress that it is intending to engage with, for example, such that the fitted sheet is expandable (by up to about 30%) in both the length and width so as to accommodate the fitted sheet encasing the mattress and maintaining tight-fitting (or snug) engagement therewith.

According to another optional example embodiment, the elastic band or boxer elastic is secured to the exposed edges of the front and rear panels and the first and second side panels. Thus, rather than the elastic band only being secured to portions of the exposed edges of the first and second side panels, the elastic band is secured to the entirety of each exposed edge of each of the first and rear panels and first and second side panels. Thus, according to some example embodiments, the entirety of each exposed edge of each panel comprises an elastic band or boxer elastic, for example, regardless of whether the length and/or width of the fitted sheet of the present invention is sized to be at least partially less than a similar-sized conventional or traditional fitted sheet. Optionally, the elastic band or boxer elastic can be secured along portions of the exposed edges as desired. In other example embodiments, the elastic band can be further secured to other portions of the fitted sheet as desired.

Figure 22:
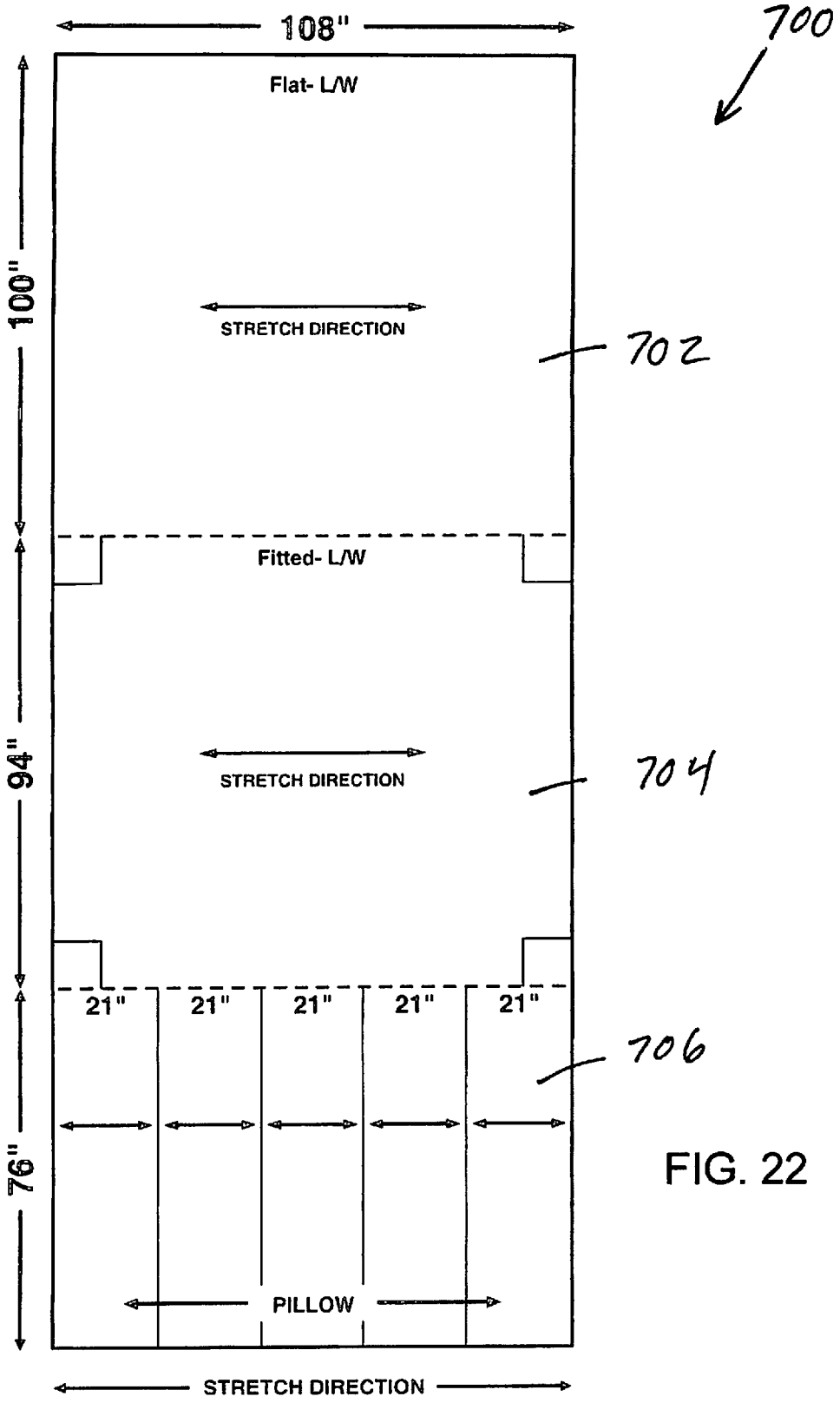
FIG. 22 shows a top plan view of an elongate sheet of stretchable fabric configured for fabricating a plurality of bedding components according to another example embodiment of the present invention.
Figure 23:
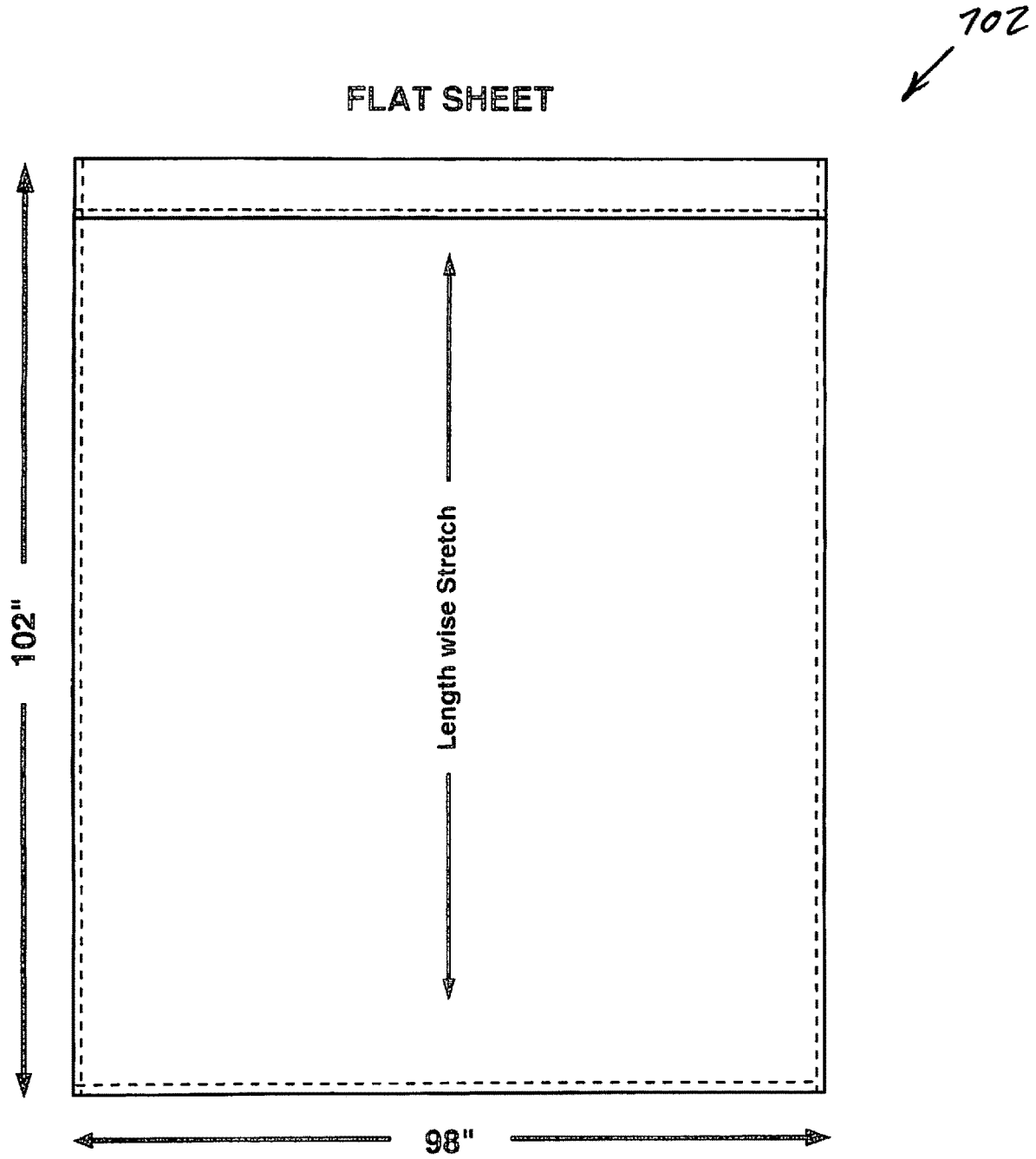
FIG. 23 shows a flat bed sheet formed from a portion of the stretchable fabric of FIG. 22, the flat bed sheet being stretchable in the length-wise direction.
Figure 24:
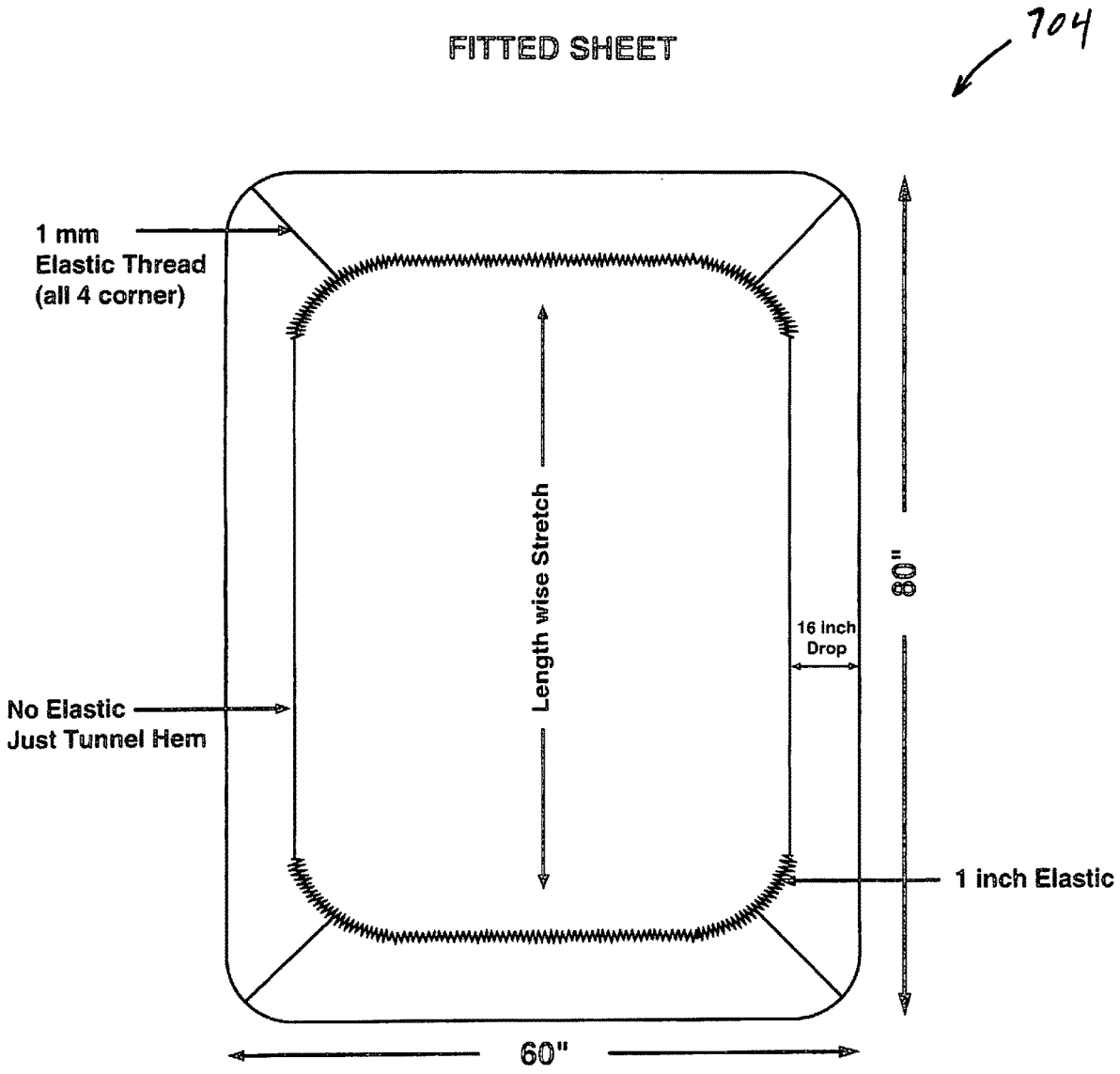
FIG. 24 shows a fitted bed sheet formed from a portion of the stretchable fabric of FIG. 22, the fitted bed sheet being stretchable in the length-wise direction.
Figure 25:
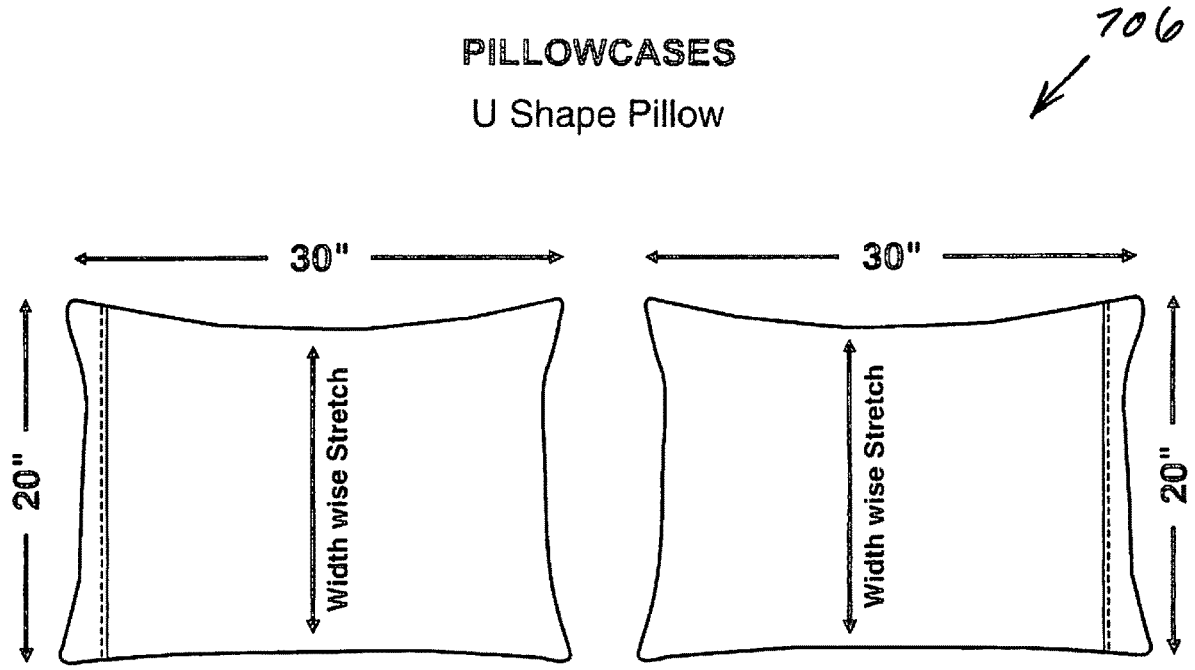
FIG. 25 shows a pair of pillow cases formed from a portion of the stretchable fabric of FIG. 22, the pair of pillow cases being stretchable in the width-wise direction.
Figure 26:
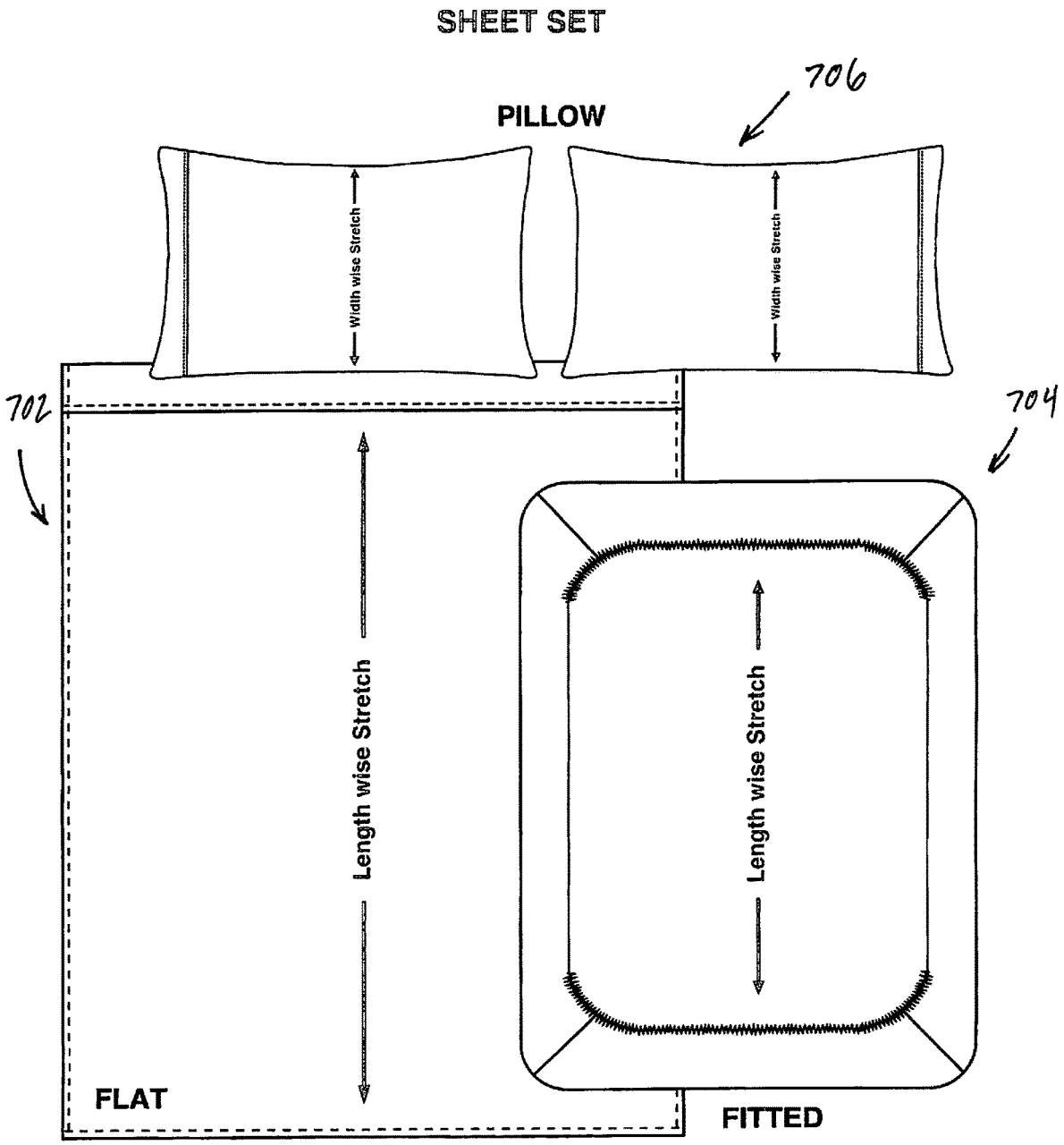
FIG. 26 shows a plurality of bedding components formed from the elongate sheet of stretchable fabric of FIG. 22.

According to additional example embodiments of the present invention, other bedding components such as flat sheets and/or pillow cases can similarly comprise a stretchable fabric as described above, for example, wherein the length and/or width of the bedding component can expand, for example, so as to provide an expanded configuration and a relaxed or retracted configuration. According to example embodiments, the expanded configuration is about 5-30% greater in the length and/or width than the length and/or width of the bedding component in the relaxed or retracted configuration. For example, according to example embodiments and as shown in FIGS. 22-26, an elongate stretchable fabric piece 700 can be fabricated (e.g., cut and sewn) to form a sheet set or at least one or more bedding components that impart at least some elasticity, for example, such that the bedding component is stretchable between a retracted state or configuration and an expanded state or configuration. As depicted in FIG. 22, the fabric piece 700 comprises a stretch direction and a plurality of cut lines are provided thereon. Thereafter, the fabric piece 700 is cut into individual pieces, which are further fabricated to form the one or more bedding components, for example a flat bed sheet 702, a fitted bed sheet 704, and one or more pillow cases 706. FIG. 23 shows the flat bed sheet 702 in greater detail, for example, which is configured to permit stretching in the length-wise direction. FIG. 24 shows the fitted bed sheet 704 in greater detail, which is similarly configured to permit stretching in the length-wise direction. FIG. 25 shows the one or more pillow cases 706 in greater detail, which are configured to permit stretching in the width-wise direction.

Figure 27:
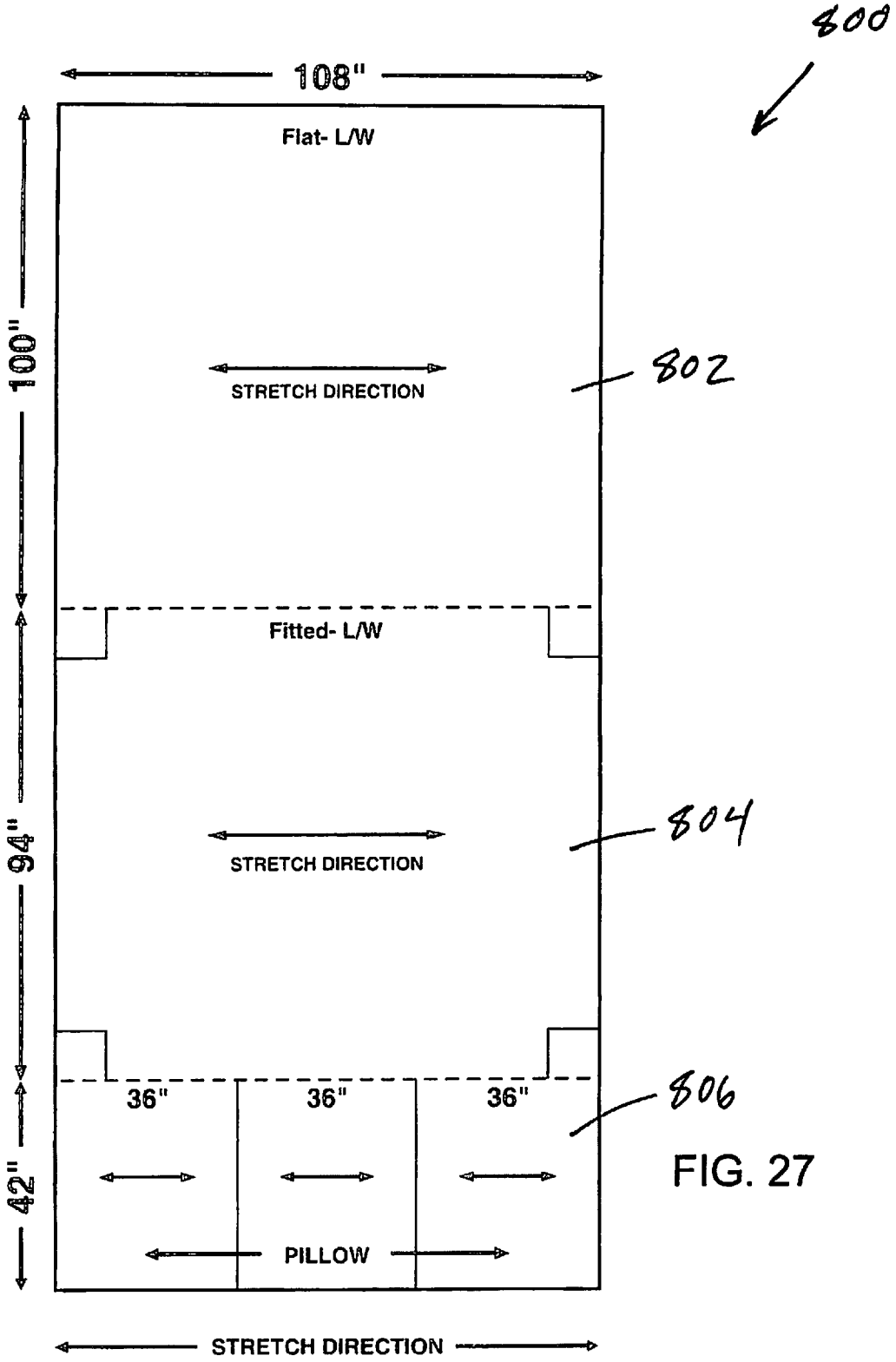
FIG. 27 shows a top plan view of an elongate sheet of stretchable fabric configured for fabricating a plurality of bedding components according to another example embodiment of the present invention.
Figure 28:
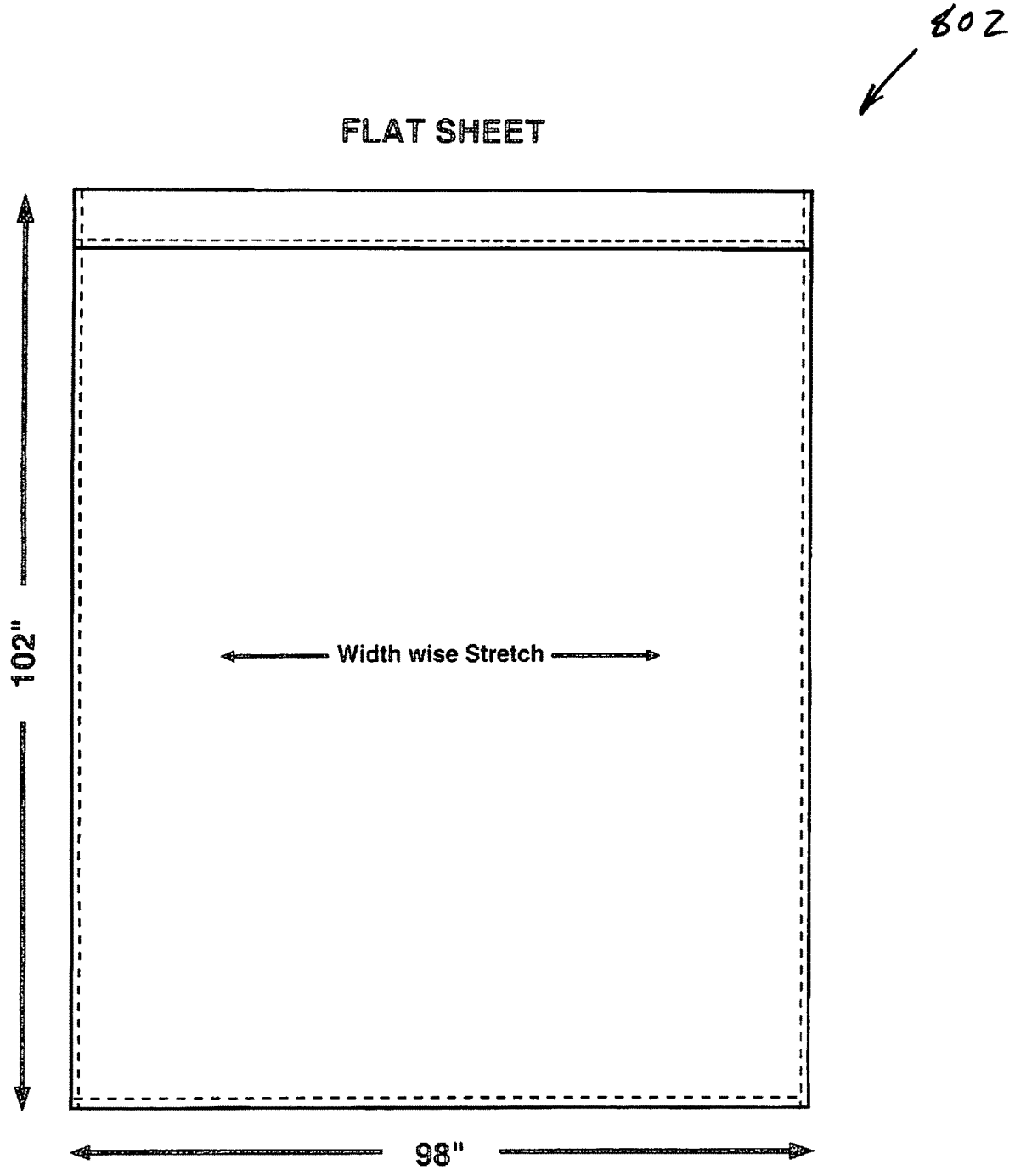
FIG. 28 shows a flat bed sheet formed from a portion of the stretchable fabric of FIG. 27, the flat bed sheet being stretchable in the width-wise direction.
Figure 29:
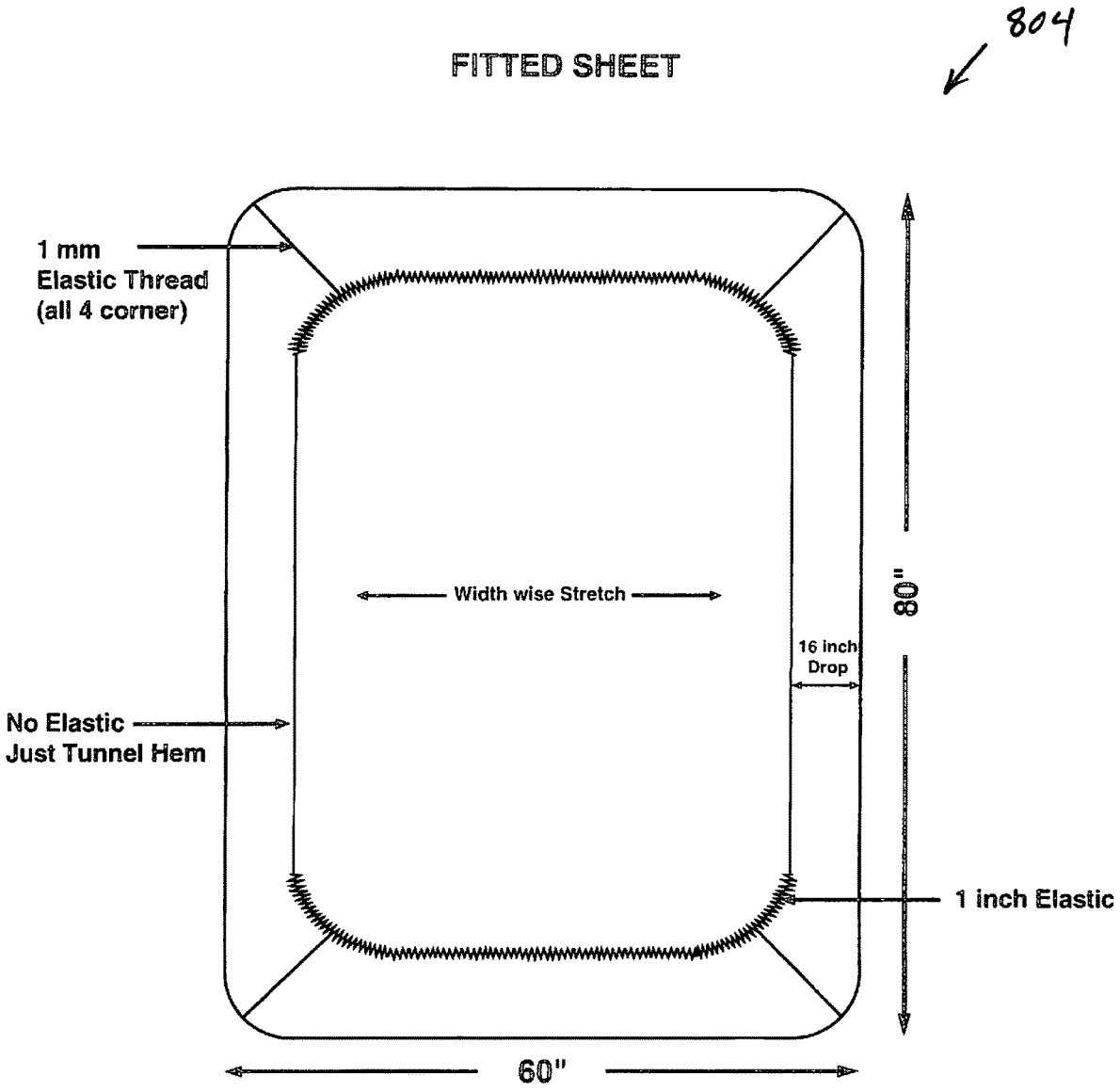
FIG. 29 shows a fitted bed sheet formed from a portion of the stretchable fabric of FIG. 27, the fitted bed sheet being stretchable in the length-wise direction.
Figure 30:
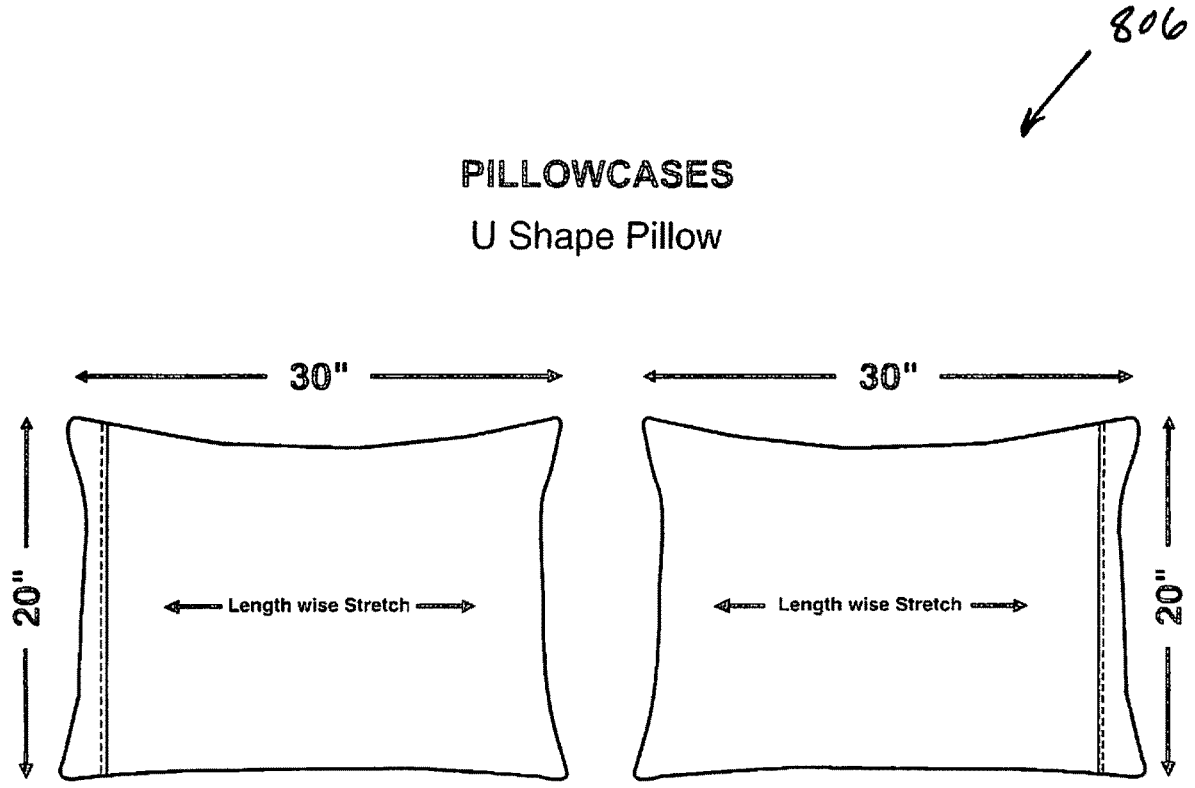
FIG. 30 shows a pair of pillow cases formed from a portion of the stretchable fabric of FIG. 27, the pair of pillow cases being stretchable in the length-wise direction.
Figure 31:
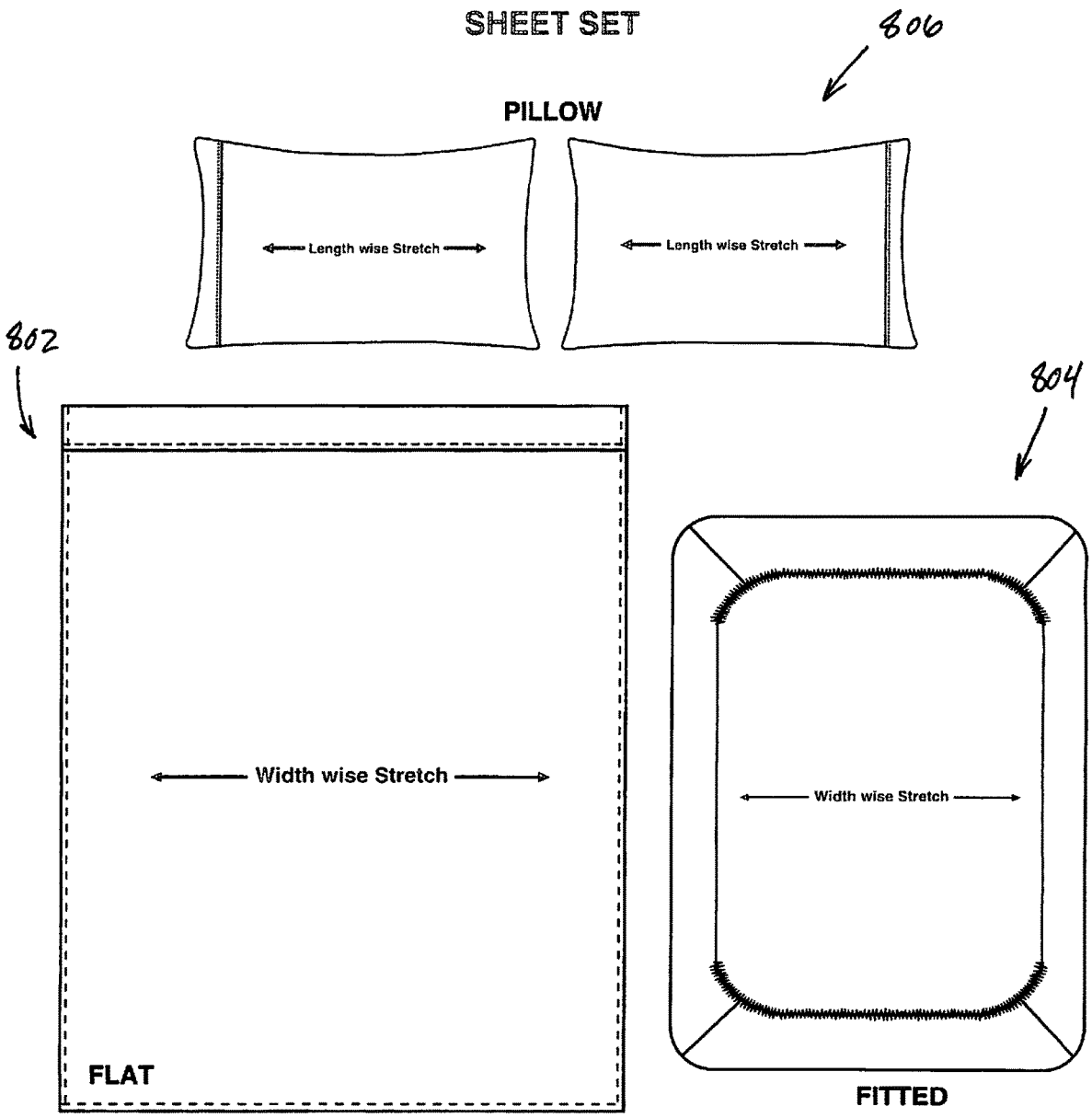
FIG. 31 shows a plurality of bedding components formed from the elongate sheet of stretchable fabric of FIG. 27.

FIGS. 27-31 show a sheet set or a plurality of bedding components according to another example embodiment. In example embodiments as similarly described above, an elongate stretchable fabric piece 800 can be fabricated (e.g., cut and sewn) to form a sheet set or at least one or more bedding components that impart at least some elasticity, for example, such that the bedding component is stretchable between a retracted state or configuration and an expanded state or configuration. As depicted in FIG. 27, the fabric piece 800 comprises a stretch direction and a plurality of cut lines are provided thereon. Thereafter, the fabric piece 800 is cut into individual pieces, which are further fabricated to form the one or more bedding components, for example a flat bed sheet 802, a fitted bed sheet 804, and one or more pillow cases 806. FIG. 28 shows the flat bed sheet 802 in greater detail, for example, which is configured to permit stretching in the width-wise direction. FIG. 29 shows the fitted bed sheet 804 in greater detail, which is similarly configured to permit stretching in the width-wise direction. FIG. 30 shows the one or more pillow cases 806 in greater detail, which are configured to permit stretching in the length-wise direction. Preferably, according to alternate example embodiments of the present invention, the stretchable fabric as described herein can preferably be configured so as to permit length-wise stretching, width-wise stretching, or for example, a combination of both width-wise and length-wise stretching (e.g., bi-directional) between a relaxed or retracted configuration and a stretched or expanded configuration.

Thus, according to some example embodiments, one or more bedding components can be constructed so as to exhibit a desired amount of deformation or expansion/retraction is either of the length-wise or width-wise directions so as to accommodate fitting with a plurality of different mattress sizes, for example, rather than being interchangeable with particular or close-in-size mattresses. For example, according to one example embodiment, a bedding component such as a fitted sheet may be configured to accommodate fitting attachment with a full mattress, a queen mattress and a California king size mattress, or for example, at least two or more mattresses of various sizes. According to one example embodiment, the various bedding components as described herein can have a thread count between about 400 threads per square inch to about 600 threads per square inch, for example, 400, 500 and 600 threads per square inch according to one example embodiment of the present invention. According to example embodiments, the stretchability of the fabric of the bedding components described herein provide substantially enhanced comfort to a user.

While the invention has been described with reference to example embodiments, it will be understood by those skilled in the art that a variety of modifications, additions and deletions are within the scope of the invention, as defined by the following claims.

What is claimed is:

1. A fitted bed sheet for at least partially encasing a mattress comprising a length, a width and a depth, the fitted bed sheet comprising a top panel, front and rear panels, and first and second side panels, wherein the front and rear panels and first and second side panels comprise first sides connected to the top panel, second sides defining exposed edges, and ends that are connected to each other to define four stitched-together corners, wherein rubber thread is provided for securing together the four stitched-together corners, thereby allowing for snug fitting engagement of the fitted bed sheet with the mattress regardless of the depth of the mattress, and wherein the stitched-together corners terminate in a V-stitch, wherein the front and rear panels and first and second side panels comprise at least one elastic member secured thereto, the top panel comprising a length and a width, wherein at least the top panel is stretchable along its length between a retracted configuration and an expanded configuration, and wherein in the retracted configuration the length of the top panel is between 12%-21% less than the length of the mattress and wherein in the expanded configuration the length of the top panel is generally similar to the length of the mattress.

2. The fitted bed sheet of claim 1, wherein in the retracted configuration the width of the top panel is generally similar to the width of the mattress and wherein in the expanded configuration the width is generally similar to the width of the mattress.

3. The fitted bed sheet of claim 1, wherein at least the top panel comprises a stretchable fabric.

4. The fitted sheet of claim 3, wherein the stretchable fabric comprises a blend of cotton and spandex.

5. The fitted sheet of claim 3, wherein the stretchable fabric comprises a blend of cotton and a rubber or other stretchable material.

6. The fitted sheet of claim 3, wherein the stretchable fabric comprises at least one fiber material selected from the group consisting of cotton fibers, polyester fibers, cellulosic fibers, synthetic fibers and biocomponent fibers.

7. The fitted sheet of claim 3, wherein at least one exposed edge of the front and rear panels comprise said elastic members secured to the entirety thereof.

8. The fitted bed sheet of claim 7, wherein a portion of the exposed edges of the first and second side panels comprise elastic members secured thereto.

9. The fitted bed sheet of claim 8, wherein the elastic members of the first and second side panels extend a length of 4 to 9 inches along the exposed edges from respective elastic members that are secured to the exposed edges of the front and rear panels.

10. The fitted bed sheet of claim 1, wherein the fitted bed sheet is configured to provide snug fitting engagement with at least two mattresses comprising differing lengths.

11. The fitted bed sheet of claim 10, wherein the at least two mattresses comprise a twin size mattress and a twin XL size mattress.

12. A fit ted bed sheet for at least partially encasing a mattress comprising a length, a width and a depth, the fitted bed sheet comprising a top panel, front and rear panels, and first and second side panels, wherein the front and rear panels and first and second side panels comprise first sides connected to the top panel, ends that are connected to each other to define four stitched-together corners, and second sides defining exposed edges, wherein rubber thread is provided for securing together the four stitched-together corners, thereby allowing for snug fitting engagement of the fitted bed sheet with the mattress regardless of the depth of the mattress, the top panel comprising a length and a width, at least a portion of the one or more panels comprising a stretchable fabric and at least a portion of the front, rear and first and second side panels comprising an elastic band secured thereto, the elastic band extending along at least a portion of the front and rear panels and at least one elastic band extending along and terminating within at least one of the first and second side panels, wherein the fitted bed sheet in a relaxed state comprises a first size, the first size being smaller than the mattress, and wherein an expanded state the fitted bed sheet comprises a second size, the second size being large enough so as to at least partially encase the mattress.

13. The fitted bed sheet of claim 12, wherein the fitted bed sheet is at least stretchable along its length between a relaxed state and an expanded state, and wherein in the relaxed state the length of the top panel is between 5%-30% less than the length of the mattress and wherein in the expanded state the length of the top panel is generally similar to the length of the mattress.

14. The fitted bed sheet of claim 12, wherein in the relaxed state the width of the top panel is generally similar to the width of the mattress and wherein in the expanded state the width is generally similar to the width of the mattress.

15. The fitted bed sheet of claim 12, wherein the exposed edges of the front and rear panels comprising elastic members secured to the entirety thereof, and a portion of the exposed edges of the first and second side panels comprising elastic members secured thereto.

16. The fitted bed sheet of claim 12, wherein the fitted bed sheet is at least stretchable along its width between a relaxed state and an expanded state, and wherein in the relaxed state the width of the top panel is between 5%-30% less than the width of the mattress and wherein in the expanded state the width of the top panel is generally similar to the width of the mattress.

17. The fitted bed sheet of claim 12, wherein in the relaxed state the length of the top panel is generally smaller than the length of the mattress and wherein in the expanded state the length of the top panel is generally similar to the length of the mattress.

18. The fitted bed sheet of claim 12, wherein the fitted bed sheet is stretchable along its length and width between a relaxed state and an expanded state, and wherein in the relaxed state the length and width of the top panel is between 5%-30% less than the length and width of the mattress and wherein in the expanded state the length and width of the top panel is generally similar to the length and width of the mattress.

19. The fitted bed sheet of claim 12, wherein the elastic band extend a length of 4 to 9 inches along the first and second side panels.

20. A stretchable bedding component elastically deformable between a retracted state and an expanded state, the bedding component being retractable and expandable so as to permit stretching of the bedding component in a first direction, a second direction that is perpendicular to the first direction, or bi-directional in both the first and second directions, the retracted state of the bedding component being between 5-30% smaller than the expanded state of the bedding component, wherein the bedding component comprises at least one elastic member secured thereto and wherein the bedding component comprises corner seams terminating in a V-stitch, wherein rubber thread is provided for securing together the corner seams, thereby allowing for snug fitting engagement of the fitted bed sheet with the mattress regardless of the depth of a mattress.

21. The stretchable bedding component of claim 20, wherein a fitted bed sheet, a flat bed sheet, and at least one pillow case are each formed from a single elongate fabric sheet, the fabric sheet comprising at least polyester and cotton yarns.

22. The stretchable bedding component of claim 21, wherein the polyester yarn comprises up to 37% plant-derived ingredients, and wherein the polyester yarn comprises a helical structure such that the polyester yarn is elastically stretchable between a natural state and an expanded state.

* * * * *